US007775871B2

(12) United States Patent
Nelson

(10) Patent No.: US 7,775,871 B2
(45) Date of Patent: Aug. 17, 2010

(54) APPARATUS AND METHOD FOR A GAMING UNIT THAT CHANGES WITH TIME

(75) Inventor: Dwayne Nelson, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/722,199

(22) Filed: Nov. 25, 2003

(65) Prior Publication Data

US 2004/0162129 A1 Aug. 19, 2004

Related U.S. Application Data

(63) Continuation of application No. 09/790,231, filed on Feb. 21, 2001, now abandoned.

(51) Int. Cl.
*A63F 9/24* (2006.01)

(52) U.S. Cl. ..... 463/16; 463/23; 463/25

(58) Field of Classification Search ..... 463/1, 463/16–20, 22, 25, 29, 40–42
See application file for complete search history.

(56) References Cited

U.S. PATENT DOCUMENTS

| | | | | |
|---|---|---|---|---|
| 4,455,025 | A | 6/1984 | Itkis | |
| 4,635,937 | A | 1/1987 | Dickinson et al. | |
| 4,711,451 | A | 12/1987 | Pajak et al. | |
| 4,760,527 | A | 7/1988 | Sidley | |
| 4,837,728 | A | 6/1989 | Barrie et al. | |
| 4,856,787 | A | 8/1989 | Itkis | |
| 5,154,429 | A | 10/1992 | LeVasseur | |
| 5,192,076 | A | 3/1993 | Komori | |
| 5,370,399 | A | 12/1994 | Liverance | |
| 5,413,351 | A * | 5/1995 | Franklin | 273/274 |
| 5,575,717 | A | 11/1996 | Houriet et al. | |
| 5,697,843 | A | 12/1997 | Manship et al. | |
| 5,971,850 | A | 10/1999 | Liverance | |
| 6,048,269 | A * | 4/2000 | Burns et al. | 463/25 |
| 6,254,483 | B1 | 7/2001 | Acres | |
| 6,315,666 | B1 | 11/2001 | Mastera et al. | |
| 6,354,943 | B1 * | 3/2002 | Miura | 463/29 |

(Continued)

FOREIGN PATENT DOCUMENTS

DE 19542625 2/1997

(Continued)

OTHER PUBLICATIONS

Ruben Martinez, managing casinos, copyright 1995 pp. 186-187.*

(Continued)

*Primary Examiner*—Ronald Laneau
*Assistant Examiner*—Tramar Harper
(74) *Attorney, Agent, or Firm*—Weaver Austin Villeneuve & Sampson LLP

(57) ABSTRACT

An electronic gaming unit for allowing a user to play a video gambling game, may generally include a time generator that may a time signal and the video gambling game may adapt in response to the time signal. The electronic gaming unit may further include a currency-accepting mechanism that is capable of allowing the user to deposit a medium of currency and a controller operatively coupled to the display unit and the input device.

28 Claims, 24 Drawing Sheets

U.S. PATENT DOCUMENTS

| | | | | |
|---|---|---|---|---|
| 6,575,832 | B1 | 6/2003 | Manfredi et al. | 463/25 |
| 2003/0083122 | A1* | 5/2003 | Beaulieu | 463/20 |
| 2004/0133485 | A1 | 7/2004 | Schoonmaker et al. | 705/30 |

FOREIGN PATENT DOCUMENTS

| | | | | |
|---|---|---|---|---|
| DE | 196 44 691 | | 3/1998 | 17/34 |
| EP | 0919965 | A2 | 6/1999 | |
| EP | 1 063 622 | A2 | 12/2000 | |
| GB | 2151054 | * | 7/1985 | |
| GB | 2 201 279 | A1 | 8/1988 | |
| GB | 2201279 | * | 8/1988 | |
| GB | 2201279 | A * | 8/1988 | |
| GB | 2211975 | * | 7/1989 | |
| GB | 2211975 | A * | 7/1989 | |
| JP | 10263190 | A * | 10/1998 | |
| WO | WO 99/24947 | A1 | 5/1999 | |
| WO | WO 2005029279 | | 3/2005 | |

OTHER PUBLICATIONS

International Search Report mailed Dec. 12, 2003, for International Application No. PCT/US02/04901, International Filing Date, Feb. 20, 2002.

Canadian Office Action, dated Jan. 13, 2010, issued in 2,436,491.

* cited by examiner

APPARATUS AND METHOD FOR A GAMING UNIT THAT CHANGES WITH TIME

This patent is a continuation of U.S. Ser. No. 09/790,231, filed Feb. 21, 2001, now abandoned which is incorporated by reference herein in its entirety.

FIELD OF THE INVENTION

The invention relates generally to apparatus and methods for gaming units, more specifically, to apparatus and methods for gaming units that change with time.

BACKGROUND OF THE INVENTION

Gaming units continue to become increasingly complex. Older gaming units such as slot machines merely required a player to insert a coin, pull a lever and examine three spinning reels to determine whether the same symbol appears in the winning position on all three reels, meaning the player was a winner. There were no bonus rounds and players only had to review one line of symbols (the pay line) to determine whether a winner was received. Further, coins were received as winnings.

Modern gaming units are designed to be more attractive to users and to be appealing to a wider range of users. Modern gaming units can incorporate games beyond traditional slot machines to make the games more interesting. Additional features and themes have also been added to slot machines to make them more interesting and appealing to a wider variety of players. To further increase ease of play, other types of monetary media have been introduced that allow a user to pay for and receive payment such as electronic funds transfer cards and tickets/vouchers. However, once gaming units are built, they cannot be easily changed or reprogrammed to better reflect the setting in which they are located.

SUMMARY OF THE INVENTION

According to one aspect, the invention may be embodied in an electronic gaming unit for allowing a user to play a video gambling game. Such an electronic gaming unit may include a time generator that may generate a time signal indicative of a time of day. The electronic gaming unit may further include a display unit that may be capable of generating color images. The electronic gaming unit may further include an input device that allows the user to make an input. The electronic gaming unit may further include a currency-accepting mechanism that is capable of allowing the user to deposit a medium of currency and a controller operatively coupled to the display unit and the input device. The controller may include a processor and a memory operatively coupled to the processor. The controller may be programmed to allow the user to make a wager after the currency-accepting mechanism detects deposit of currency by the user, and to cause a sequence of video images to be generated on the display unit after the currency-accepting mechanism detects deposit of currency by the user, the sequence of video images representing a video gambling game selected from the group of available video gambling games consisting of video poker, video slots, video blackjack, video keno and video bingo. The controller may additionally be programmed to replace at least one of the available video gambling games in response to the time signal. The controller may be further programmed to determine, after the sequence of images has been displayed, an outcome of the video gambling game represented by the sequence of images and to determine a currency payout associated with the outcome of the video gambling game.

According to another aspect, the invention may be embodied in an electronic gaming unit for allowing a user to play a video gambling game. Such an electronic gaming unit may include a time generator that may generate a time signal indicative of a time of day. The electronic gaming unit may further include a display unit that may be capable of generating color images. The electronic gaming unit may further include an input device that allows the user to make an input. The electronic gaming unit may further include a currency-accepting mechanism that is capable of allowing the user to deposit a medium of currency and a controller operatively coupled to the display unit and the input device. The controller may include a processor and a memory operatively coupled to the processor. The controller may be programmed to allow the user to make a wager after the currency-accepting mechanism detects deposit of currency by the user, and to cause a sequence of video images to be generated on the display unit after the currency-accepting mechanism detects deposit of currency by the user, the sequence of video images representing a video gambling game selected from the group of video gambling games consisting of video poker, video slots, video blackjack, video keno and video bingo. The controller may additionally be programmed to change a minimum bet for the video gambling game in response to the time signal. The controller may be further programmed to determine, after the sequence of images has been displayed, an outcome of the video gambling game represented by the sequence of images and to determine a currency payout associated with the outcome of the video gambling game.

According to a further aspect, the invention may be embodied in an electronic gaming unit for allowing a user to play a video gambling game. Such an electronic gaming unit may include a time generator that may generate a time signal indicative of a time of day. The electronic gaming unit may further include a display unit that may be capable of generating color images. The electronic gaming unit may further include an input device that allows the user to make an input. The electronic gaming unit may further include a currency-accepting mechanism that is capable of allowing the user to deposit a medium of currency and a controller operatively coupled to the display unit and the input device. The controller may include a processor and a memory operatively coupled to the processor. The controller may be programmed to allow the user to make a wager after the currency-accepting mechanism detects deposit of currency by the user, and to cause a sequence of video images to be generated on the display unit after the currency-accepting mechanism detects deposit of currency by the user, the sequence of video images representing a video gambling game selected from the group of video gambling games consisting of video poker, video slots, video blackjack, video keno and video bingo. The controller may additionally be programmed to change a denomination for the deposit of currency for the video gambling game in response to the time signal. The controller may be further programmed to determine, after the sequence of images has been displayed, an outcome of the video gambling game represented by the sequence of images and to determine a currency payout associated with the outcome of the video gambling game.

According to another aspect, the invention may be embodied in an electronic gaming unit for allowing a user to play a video gambling game. Such an electronic gaming unit may include a time generator that may generate a time signal indicative of a time of day. The electronic gaming unit may further include a display unit that may be capable of generating color images. The electronic gaming unit may further include an input device that allows the user to make an input. The electronic gaming unit may further include a currency-accepting mechanism that is capable of allowing the user to deposit a medium of currency and a controller operatively coupled to the display unit and the input device. The controller may include a processor and a memory operatively coupled to the processor. The controller may be programmed to allow the user to make a wager after the currency-accepting mechanism detects deposit of currency by the user, and to cause a sequence of video images to be generated on the display unit after the currency-accepting mechanism detects deposit of currency by the user, the sequence of video images representing a video gambling game selected from the group of video gambling games consisting of video poker, video slots, video blackjack, video keno and video bingo. The controller may additionally be programmed to change a maintenance schedule of the gaming unit in response to the time signal. The controller may be further programmed to determine, after the sequence of images has been displayed, an outcome of the video gambling game represented by the sequence of images and to determine a currency payout associated with the outcome of the video gambling game.

According to another aspect, the invention may be embodied in an electronic gaming unit for allowing a user to play a video gambling game. Such an electronic gaming unit may include a time generator that may generate a time signal indicative of a time of day. The electronic gaming unit may further include a display unit that may be capable of generating color images. The electronic gaming unit may further include an input device that allows the user to make an input. The electronic gaming unit may further include a currency-accepting mechanism that is capable of allowing the user to deposit a medium of currency and a controller operatively coupled to the display unit and the input device. The controller may include a processor and a memory operatively coupled to the processor. The controller may be programmed to allow the user to make a wager after the currency-accepting mechanism detects deposit of currency by the user, and to cause a sequence of video images to be generated on the display unit after the currency-accepting mechanism detects deposit of currency by the user, the sequence of video images representing a video gambling game selected from the group of video gambling games consisting of video poker, video slots, video blackjack, video keno and video bingo. The controller may additionally be programmed to replace a first available bonus game for a second available bonus game in response to the time signal. The controller may be further programmed to determine, after the sequence of images has been displayed, an outcome of the video gambling game represented by the sequence of images and to determine a currency payout associated with the outcome of the video gambling game.

The features and advantages of the present invention will be apparent to those of ordinary skill in the art in view of the detailed description of various embodiments, which is made with reference to the drawings, a brief description of which is provided below.

DETAILED DESCRIPTION OF VARIOUS EMBODIMENTS

Figure 1:
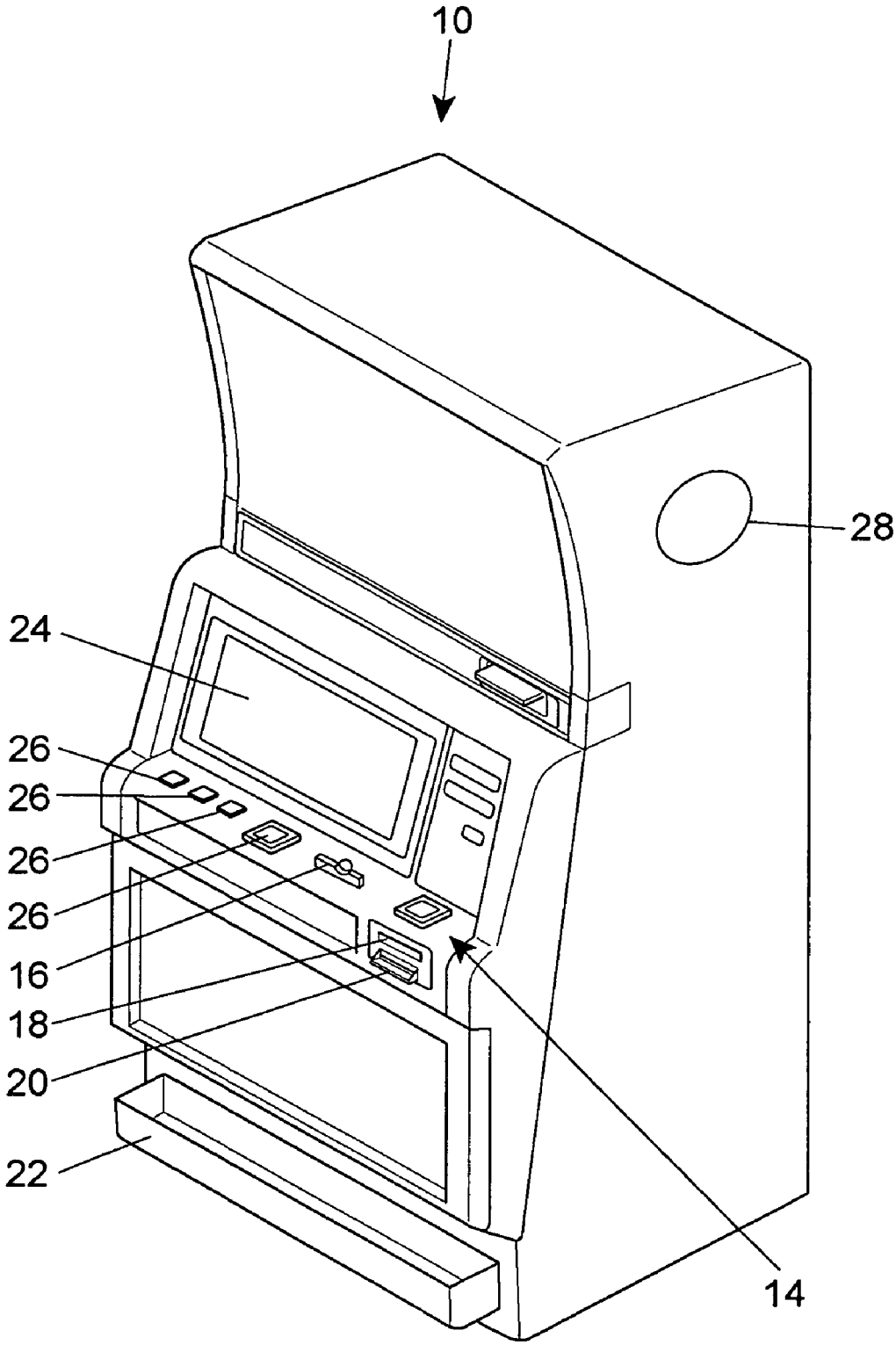
FIG. 1 is an illustration of one embodiment of an electronic gaming unit with scent capability in accordance with the claims of the invention.

Referring to FIG. 1, one embodiment of an electronic gaming unit 10 with a time generator 12 (FIG. 2) is illustrated. The electronic gaming unit 10 may have a housing made of wood or other sturdy material. The electronic gaming unit 10 may have a currency accepting mechanism 14 such as a coin acceptor 16, a dollar bill acceptor 18, a debit card acceptor 20 and acceptors of other monetary media. The electronic gaming unit 10 also may have a coin payout tray 22 and may have a display unit 24 on which various games such as blackjack, five card draw poker, seven card draw poker, keno, slots, bingo and the like may be displayed. The electronic gaming unit 10 may have several input devices 26 such as push buttons, a touch screen, a joystick, a track ball or the like which may assist in selecting and playing a game. The electronic gaming unit 10 may also be outfitted with audio speakers 28 and a scent generator 29 (FIG. 2) to provide audio and scent stimulation, respectively.

Generally, the user may employ the display unit 24 and the input devices 26 to gamble by playing games such as, for example, video poker, video blackjack, video slot machine games (also referred to hereinafter as "video slots"), video keno, video bingo or video matching games. As will be appreciated by those having ordinary skill in the art, the types of gambling games that may be implemented on the electronic gaming unit 10 are virtually limitless. Accordingly, any gambling games disclosed herein are presented purely for reasons of example and are not intended to be limiting in any manner. The game also may be a traditional mechanical spinning reel slot machine game. In addition, other gambling games such as Montana poker may be implemented on the electronic gaming unit 10.

To facilitate user interface with the electronic gaming unit 10, a touch-sensitive input device 30 may be provided. The touch-sensitive input device 30 may be a touch screen that may be mounted over, or incorporated into, the display unit 24. The user may employ the display unit 24 and the touch-sensitive input device 30 to gamble by playing games such as, for example, video poker, video blackjack, video slots, video keno or video bingo. Such a touch screen may be available from MicroTouch or any other suitable vendor.

The display unit 24 may be a color display, a monochrome display or any other suitable display. Further, the display unit 24 may be embodied in a cathode ray tube (CRT) monitor, a plasma display, a liquid crystal display (LCD) or any other suitable display technology. For example, the display unit 24 may be embodied in a Multisync LCD Model 1810 available from NEC Technologies. The display unit 24 is controlled to enable the user to play video gambling games thereon. For example, as is described in more detail hereinafter, the display unit 24 may display graphics representative of, for example, slot machine reels, playing cards, dice or any other suitable symbols to enable a user to play a video versions of commonly known casino games. The touch-sensitive input device 30 enables the user to interact with the electronic gaming unit 10 to, for example, make wagers, to select cards, to discard cards and to perform any other suitable functions that correspond to traditional casino games. Further detail regarding exemplary graphics that may be displayed on the display screen is provided hereinafter with respect to FIGS. 5, 7, 9, 11 and 13.

Figure 2:
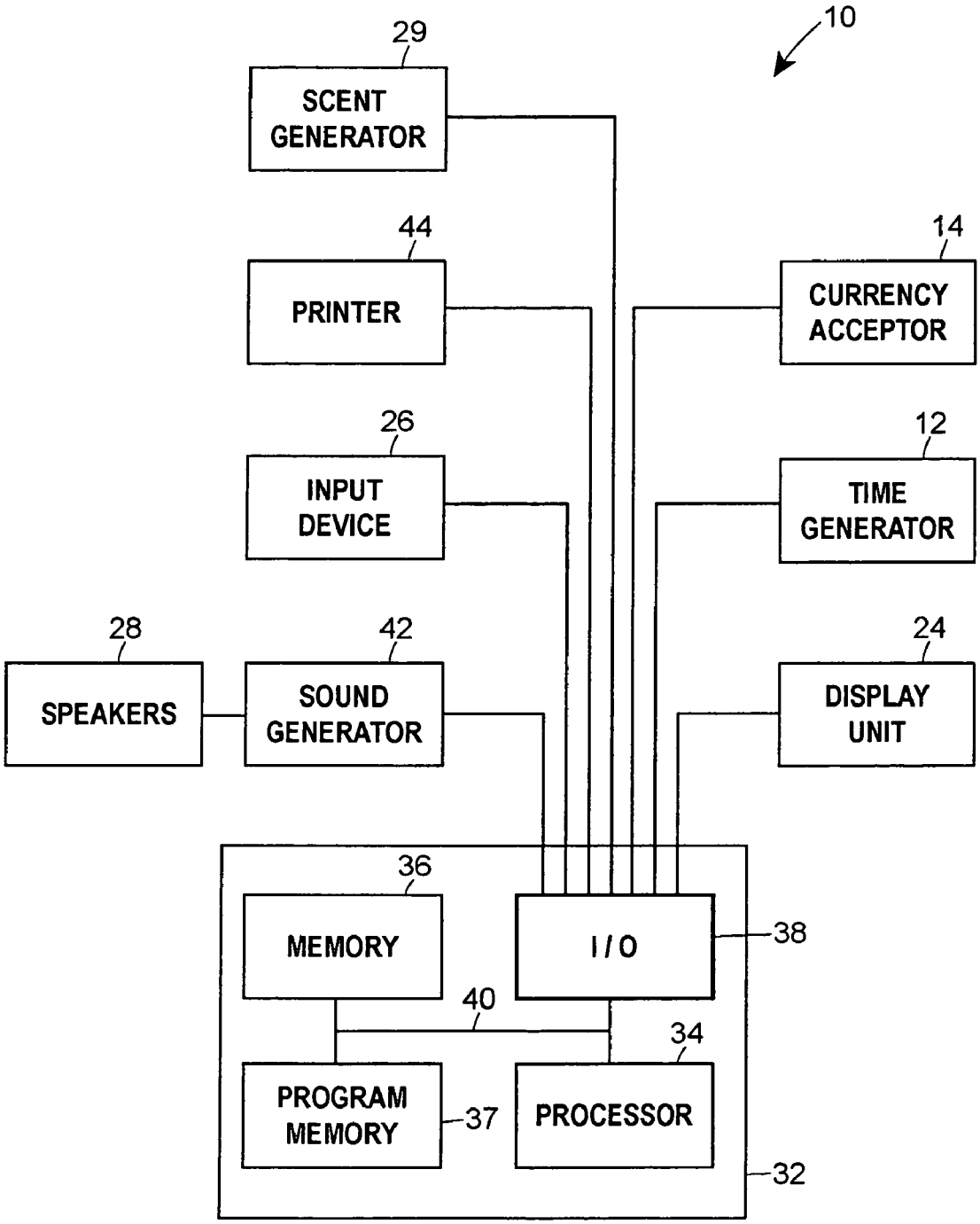
FIG. 2 is an exemplary block diagram of the hardware components of the electronic gaming unit of FIG. 1.

Referring to FIG. 2, a controller 32 may be disposed within the electronic gaming unit 10. The controller 32 may be coupled to the time generator 12, the currency acceptor 14, the display unit 24, the input devices 26 and the scent dispenser 29 via a cabling harness (or bus) running through the interior of the electronic gaming unit 10. The controller 32 may be embodied in hardware that is commercially available in, for example, the International Game Technology "Game King" platform for video gaming units. The controller 32 may be embodied in a 16 or 32 bit, 16 megahertz (MHZ) 80C960SA microcontroller, which is commercially available from Intel, or may be embodied in any other suitable microcontroller. The controller 32 may include a processor 34 that is communicatively coupled to both of a memory 36, a program memory 37 and an input/output circuit 38, via a bus 40. The memory 36 of the controller 32 may be a random access memory (RAM) and the program memory 37 may be a read-only memory (ROM). Alternatively or additionally, an additional memory may be communicatively coupled to the controller 32. For example, a memory such as any one, or any suitable combination, of an electrically erasable programmable read only memory (EEPROM), a one time programmable electrically programmable read only memory (OTP EPROM), a static random access memory (SRAM), FLASH or any other suitable memory element may be externally connected to the controller 32. Further detail regarding the functionality of the controller 32 is described hereinafter with respect to FIGS. 3-21.

The audio speakers 28, which may be embodied in speakers that are commercially available from Boston Acoustics under model number $CX9^3$, or may be embodied in any other suitable speakers, cooperate with a sound generator 42 to provide various forms of audio that are relevant to the video gambling game that the user is playing. For example, the sound generator 42, which may be any suitable and known audio generating circuit and may be responsive to the controller 32, may generate signals representing sounds such as the noise of spinning slot machine reels, a dealers voice, music, announcements or any other suitable audio related to a video gambling game.

The currency accepting mechanism 14 may be disposed within the gaming unit 10 in any suitable location. The currency accepting mechanism 14 may be embodied in any device that can accept value from the user. For example, the currency accepting mechanism 14 may be a bill validator, a smart card reader, a token acceptor or any other suitable and known device capable of handling currency, token or electronic currency. By way of a particular example, the currency accepting mechanism 14 may be embodied in a bill validator that is commercially available from Japanese Coin Mechanisms (JCM) under model number WBA-12-SS. As shown in FIG. 2, the currency accepting mechanism may be coupled to, and controlled by, the controller 32. When a user deposits value into the currency accepting mechanism 14, a representation of the value that the user has may be displayed to the user on the display unit 24. As the user plays various video gambling games, the value may be incremented as the user wins and may be decremented as the user loses.

A printer 44 may also be disposed in the electronic gaming unit 10 in any suitable location. The printer 44, which may be responsive to the controller 32, may be used for printing tickets of the winnings of a user. For example, when a user desires to cash out, the printer 44 may print a ticket having the number of user credits printed thereon. The user may then redeem the printed ticket for cash, a check or credit at a casino facility. Alternatively, if the electronic gaming unit 10 is used for lottery purposes, the printed ticket may be redeemed at a lottery facility. One exemplary printer 44 is available from SEIKO Instruments USA, Inc. under model number PSA-66-000N.

Overall Operation

Referring now to FIGS. 3, 4, 6, 8, 10, and 12, a number of routines are shown that are illustrated using blocks, which represent functions that may be embodied in software instructions stored in the memory 36 (FIG. 2) and carried out by the processor 34. The instructions may be written in any suitable high level language such as, for example, any suitable version of C, C++ or the like. Alternatively, instructions for implementing the functional blocks may be written in any suitable assembly or machine level language.

Figure 3:
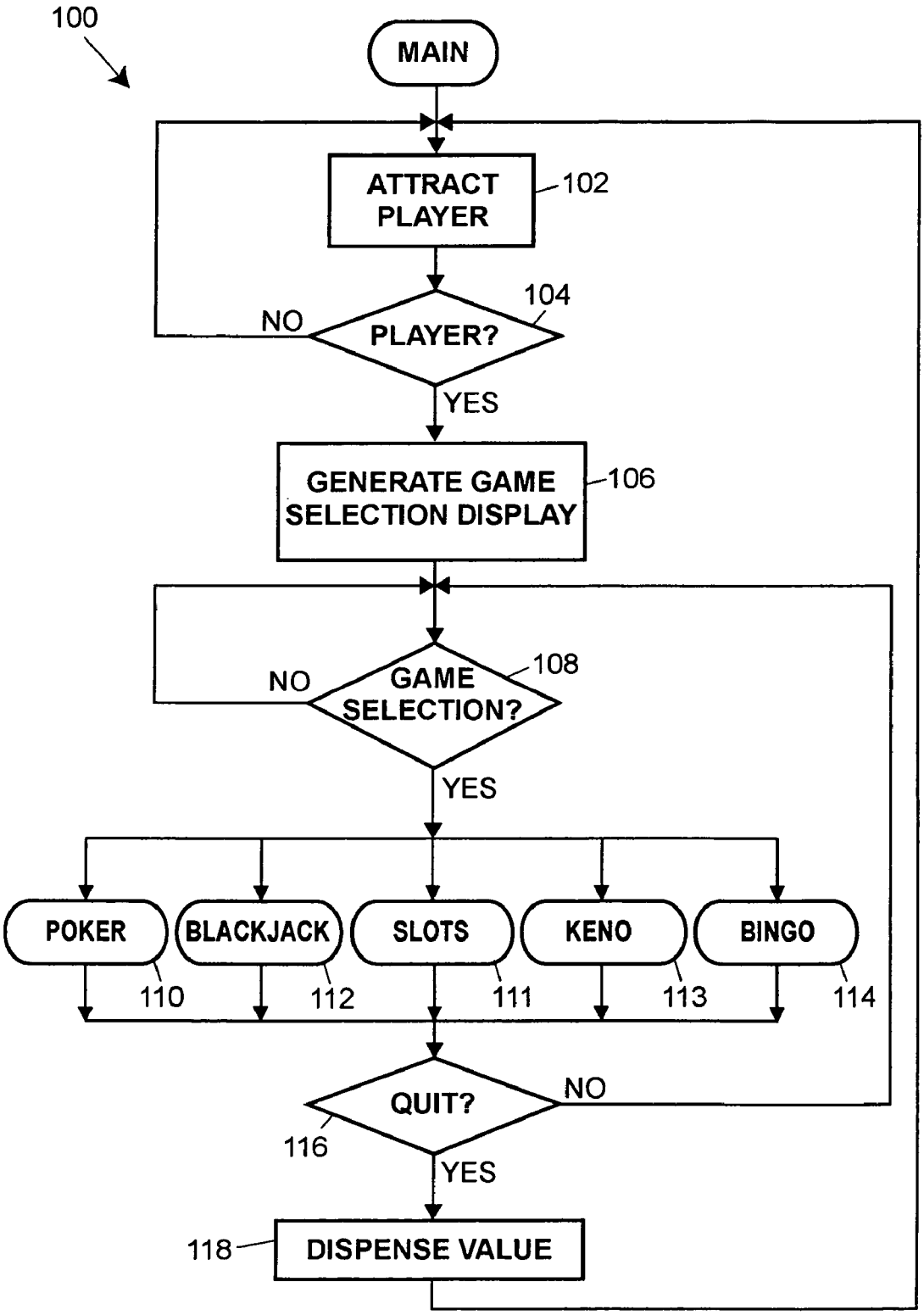
FIG. 3 is an exemplary flow diagram of a main control routine that may be implemented by the controller of FIG. 2.

As shown in FIG. 3, a main routine 100 may begin execution at a block 102 at which user attraction graphics may be displayed on the display unit 24. User attraction graphics may include a scrolling list of games that may be played on the electronic gaming unit 10, animations, videos, etc. While graphics are being displayed, a block 104 intermittently checks to see whether a user is detected. Such a function may be carried out by, for example, polling the currency accepting mechanism 14. Any value that the user deposits will be stored as credit. As long as no user is detected, control passes from the block 104 back to the block 102. If, however, the block 104 determines that a user is present, control passes to a block 106.

The execution of the block 106 may cause the display unit 24 to display a game selection graphic to the user. The game selection graphic may include a list of video gambling games that may be played on the electronic gaming unit 10. After the block 106 displays the list of available video gambling games to the user, a block 108 detects which game has been selected and branches control to one of subroutines 110-114, each of which represents a particular video gambling game. It should be noted that although five subroutines are shown in FIG. 3, more, fewer or different subroutines representing more, fewer or different video gambling games may be used. Accordingly, more, fewer or different video gambling games may be present on any given electronic gaming unit 10. The description of the subroutines 110-114 is undertaken with respect to FIGS. 4, 6, 8, 10 and 12 after the remaining blocks of FIG. 3 are described.

After one of the subroutines 110-114 have been executed, control passes to a block 116, which queries whether the user has expressed a desire to stop playing the electronic gaming unit 10. The user may express such a desire by selecting a quit graphic displayed on the display unit 24 or through any other suitable manner that informs the controller 32 of the user's desire to stop playing the electronic gaming unit 10. If the user does not desire to quit, control passes from the block 116 back to the block 108 so that the user may select another video gambling game to play. If, however, the user desires to quit, control may pass from the block 116 to block 118 where value may be dispensed to the user based on the outcome of the games played by the user and then to block 102, at which time the electronic gaming unit 10 again displays graphics to attract another user.

Video Poker

Figure 4:
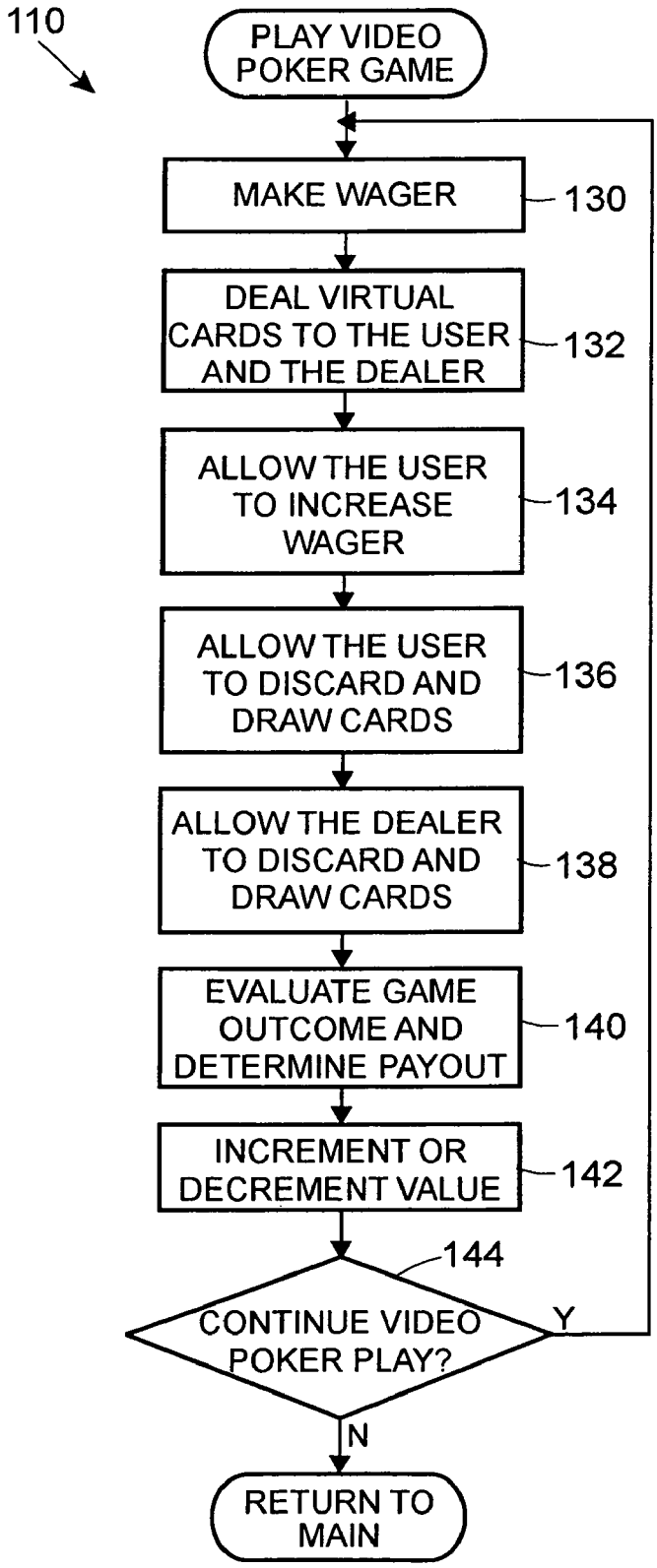
FIG. 4 is an exemplary flow diagram of a play video poker game routine that may be implemented by the controller of FIG. 2.

When the block 108 determines that the user desires to play a video poker game, control passes to the subroutine 110, which is illustrated in detail in FIG. 4. As described hereinafter, the various blocks of the subroutine 110 illustrate various functions that are carried out by the controller 32 in conjunction with the display unit 24 to make certain graphics appear on the display unit 24. Exemplary graphics for a video poker game are shown and described in conjunction with FIG. 5.

At a block 130, the subroutine 110 requests the user to make a wager and, after a wager is entered, control passes to a block 132, at which virtual hands of cards are dealt to the user and to the dealer, which is the opponent of the user (e.g., the dealer may be considered to be the controller 32, which is competing against the user). After the virtual hands have been dealt to the user and the dealer, the user may have an opportunity at block 134 to increase the initial wager made at the block 130. After the block 134 executes, control passes to a block 136, which allows the user to discard and draw cards in an attempt to improve the user's virtual hand.

After the user has had the opportunity to improve his or her hand at the block 136, control passes to a block 138, at which the dealer has the opportunity to improve its hand by discarding and drawing cards. After the block 138 has completed, control passes to a block 140, at which the controller 32 determines the outcome of the game and determines the payout. If the user has won the game (e.g., the user's hand is better than the dealer's hand), the payout will be positive. If, however, the user has not won the game, the user may forfeit his wagers made at the block 130 and 134. After the block 140 has determined the outcome, control passes to a block 142, which increments or decrements the user's value based on the results determined at the block 140.

After the user's value has been incremented or decremented at the block 142, a block 144 queries whether the user desires to continue playing the video poker game. If the user desires to play the video poker game again, control passes from the block 144 back to the block 130, which requests the user to make a wager. If the user does not desire to continue playing the video poker game, execution returns to the block 116 of the routine 100 of FIG. 3.

Figure 5:
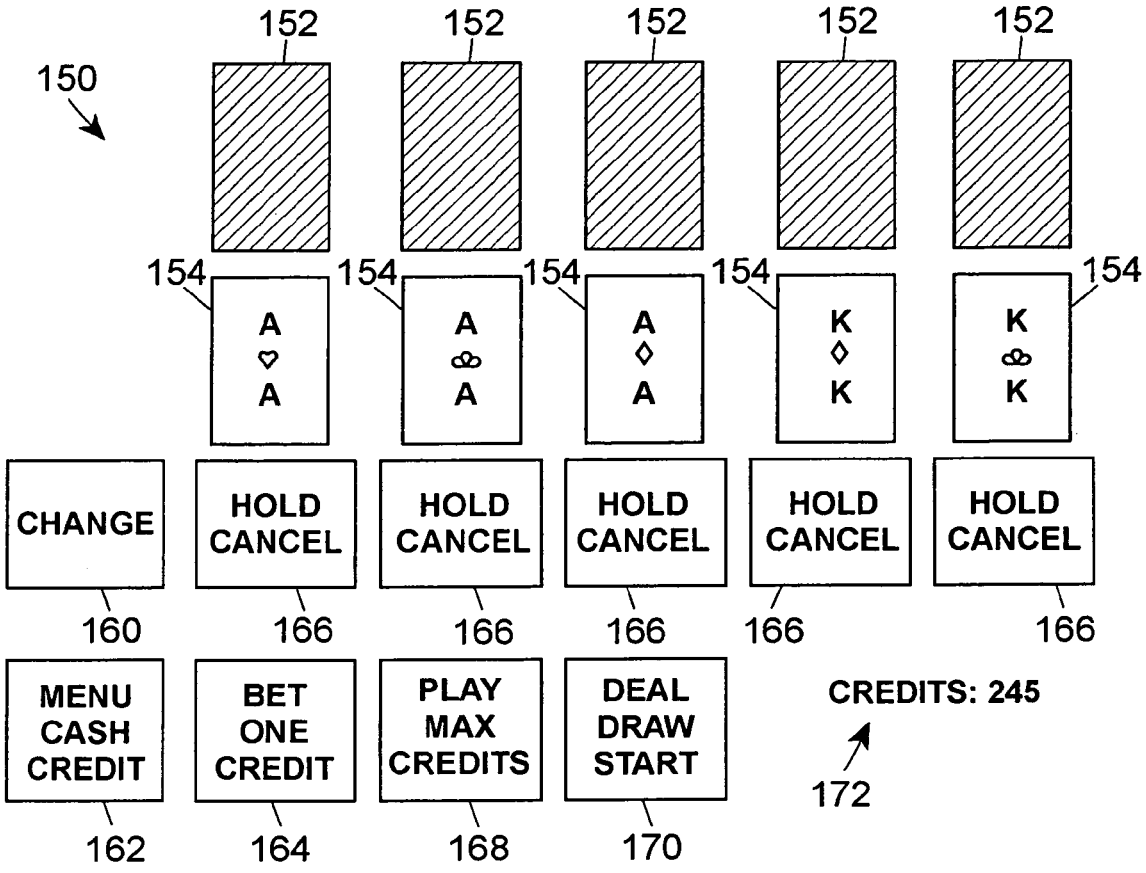
FIG. 5 is an exemplary illustration of graphics that may be displayed on the display unit when the controller of FIG. 2 executes the play video poker game routine of FIG. 4.

As shown in FIG. 5, an exemplary video display 150, which may be associated with the play video poker game routine 110, may include video images representative of a plurality of cards 152 in a dealer's hand, which may be shown face down, and a plurality of cards 154 in a users hand, which may be shown face up. To allow the user to control the play of the video poker game, a plurality of button graphics may be displayed. In particular, button graphics for change 160, menu/cash/credit 162 and bet one credit 164 may be displayed. Further, button graphics for hold/cancel 166 may be displayed, each of which may pertain to a particular one of the user's cards 154. Button graphics for play max credits 168 and deal/draw/start 170 may also be displayed. As noted previously, the touch-sensitive input device 30 may be a touch screen that may be disposed over the display unit 24. Accordingly, each of the button graphics 160-170 may be associated with a particular area of the touch-sensitive input device 30 that is located between the display unit 24 and the user. A graphic representing the number of credits 172 may also be displayed to inform the user of the number of credits that he or she has remaining.

Video Slots

Figure 6:
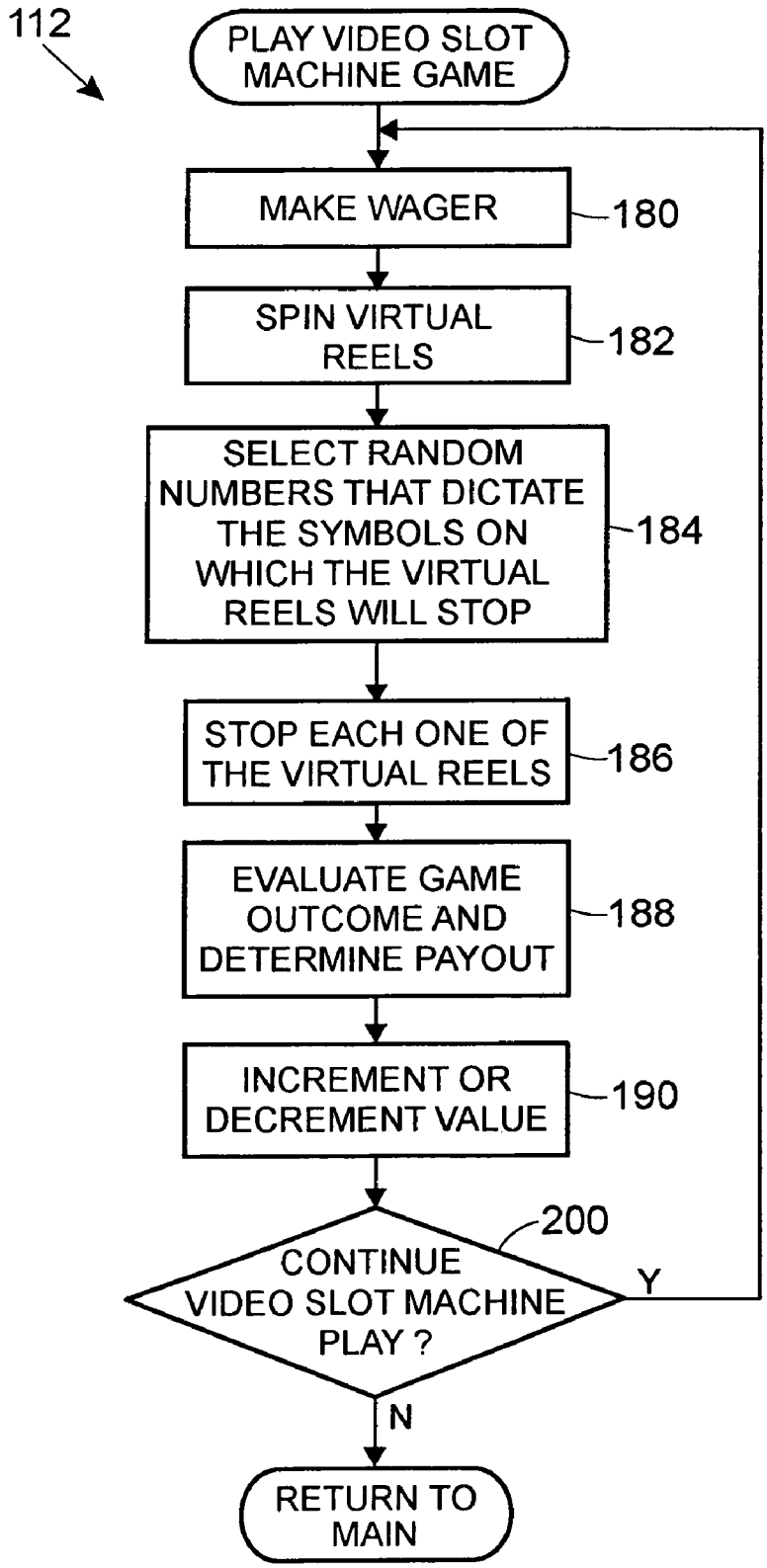
FIG. 6 is an exemplary flow diagram of a play video slot machine routine that may be implemented by the controller of FIG. 2.

When a user desires to play a video slot machine game, a play video slot machine game routine 111, as shown in FIG. 6, is executed. The routine 111 includes a number of blocks that may be embodied in software instructions stored in the memory 36 (FIG. 2). The execution of the routine 111 may begin at a block 180, at which a user may make a wager on the outcome of the video slot machine game. After the user has made an appropriate wager, control passes to a block 182. At the block 182 virtual slot machine reels, which may be embodied in video graphics, begin to spin to simulate the operation of a traditional mechanical slot machine.

While the virtual reels spin, a block 184 may select one or more random numbers that dictate the symbols on which the various virtual reels will stop when the reels cease spinning. Essentially, the block 184 determines the outcome of the video slot machine game. After the block 184 completes, control passes to a block 186, which stops each one of the virtual reels from spinning. The virtual reels may be stopped in a left to right manner, from the perspective of the user, or in any other suitable manner or sequence.

After the virtual reels have been stopped by the block 186, a block 188 evaluates the game outcome and determines the payout to which the user is entitled. For example, if a virtual reels have stopped on high payout symbols, the user may receive a large payout. If, however, the virtual reels have stopped on symbols having no payout, the user loses the money that was wagered at the block 180. After the payout has been determined at the block 188, a block 190 appropriately increments or decrements the value that the user has accumulated within the electronic gaming unit 10 and passes control to a block 200.

The block 200 determines whether the user desires to continue to playing the video slot machine game. If the user desires to play again, control passes from the block 200 back to the block 180. If, however, the user does not desire to play again, control passes to the block 116 of the main routine 100 of FIG. 3.

Figure 7:
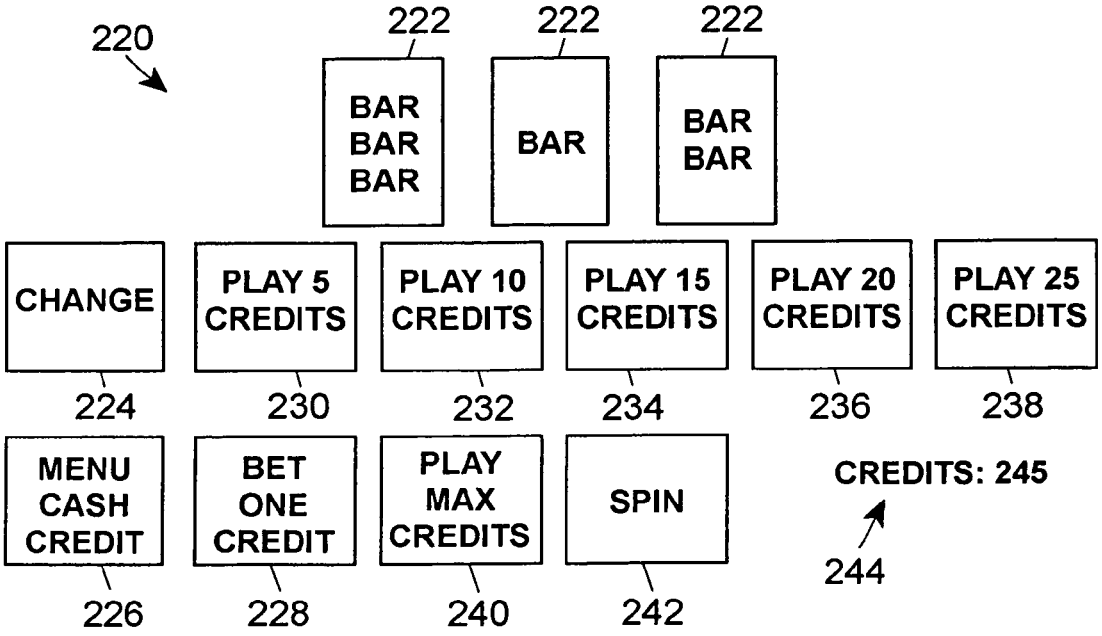
FIG. 7 is an exemplary illustration of graphics that may be displayed on the display unit when the controller of FIG. 2 executes the play video slot machine routine of FIG. 6.

As shown in FIG. 7, an exemplary video display 220, which may be associated with the play video slot machine game routine 111, may include video images that represent a plurality of virtual slot machine reels 222. While three such virtual slot machine reels 222 are shown in FIG. 7, it should be understood that any number of virtual reels could be used. To allow the user to control the play of the video slot machine, a plurality of button graphics may be displayed. In particular, button graphics for change 224, menu/cash/credit 226 and bet one credit 228 may be displayed. Further, button graphics for betting 5, 10, 15, 20 or 25 credits, shown as 230-238 in FIG. 7 may also be provided. Button graphics for play max credits 240 and spin 242 may also be displayed. As noted with respect to FIG. 5, the touch-sensitive input device 30 may be a touch screen that may be disposed over the display unit 24. Accordingly, each of the button graphics 224-242 may be associated with a particular area of the touch-sensitive input device 30 that is located between the display unit 24 and the user. A graphic representing the number of credits 244 may also be displayed to inform the user of the number of credits that he or she has remaining.

Video Blackjack

Figure 8:
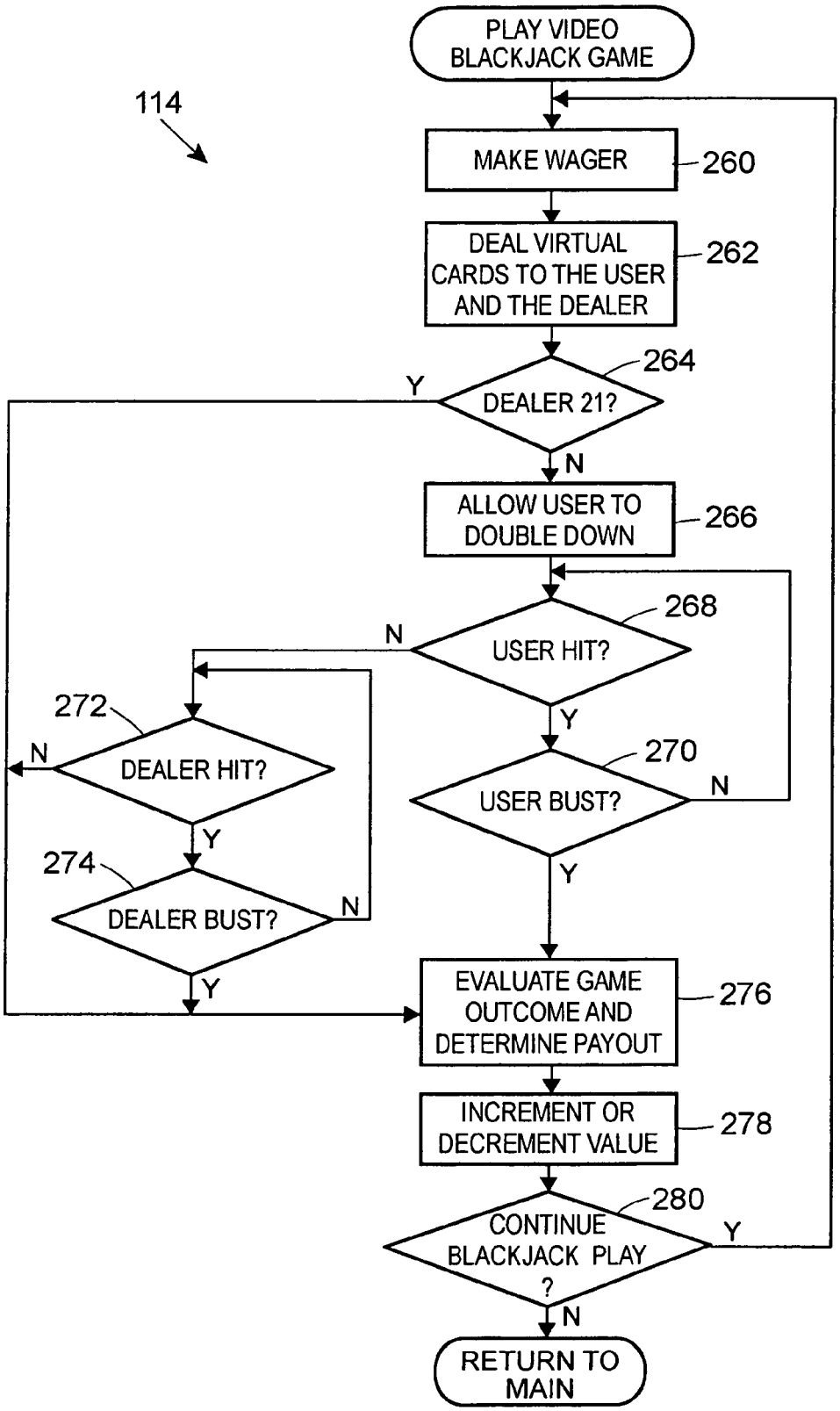
FIG. 8 is an exemplary flow diagram of a play video blackjack game routine that may be implemented by the controller of FIG. 2.

When a user desires to play a video blackjack game, a play video blackjack game routine 113, as shown in FIG. 8, is executed. The routine 112 includes a number of blocks that may be embodied in software instructions stored in the memory 36 (FIG. 2). The execution of the routine 112 may begin at a block 260 at which a user makes a wager on the outcome of the blackjack game. After the user has made a wager, a block 262 deals virtual cards to both of the user and the dealer, against which the user is playing.

After the cards are dealt, a block 264 tests whether the dealer has a hand that totals to 21. If the user does not have 21, control passes to a block 266, at which the user may double down. After the execution of the block 266, a block 268 determines whether the user wants to be "hit" (i.e., be dealt an additional card). If the user is hit, a block 270 determines if the user has "bust" (i.e., has exceeded 21). If the user has not bust, control passes back to the block 268, which allows the user to hit again.

If the user decides not to hit, control passes from the block 268 to a block 272, which determines if the dealer wants to hit. If the dealer hits, control passes to a block 274, which determines if the dealer has bust. If the dealer has not bust, control passes from the block 274 back to the block 272 to provide the dealer another opportunity to hit. If the dealer decides not to hit, control passes to a block 276, which determines the outcome of the blackjack game. For example, the block 276 may determine which of the user or the dealer has the higher hand that does not exceed 21. Additionally, if the user busts at the block 270 or the dealer busts at the block 274 or if the block 264 determines that the dealer has 21, control passes to the block 276. In sum, the block 276 performs the function of evaluating the traditional rules of blackjack and determining the magnitude of the payout that should be paid to the user.

After the block 276 determines the outcome and payout for the game, control passes to a block 278, which increments or decrements the value of the user based on the payout calculated by the block 276. Upon completion of the block 278, the block 280 determines whether the user desires to play another game of blackjack. If the user desires to play blackjack again, control passes to the block 260. Alternatively, if the user does not desire to play blackjack again, control passes to the block 116 of the main routine 100 of FIG. 3.

Figure 9:
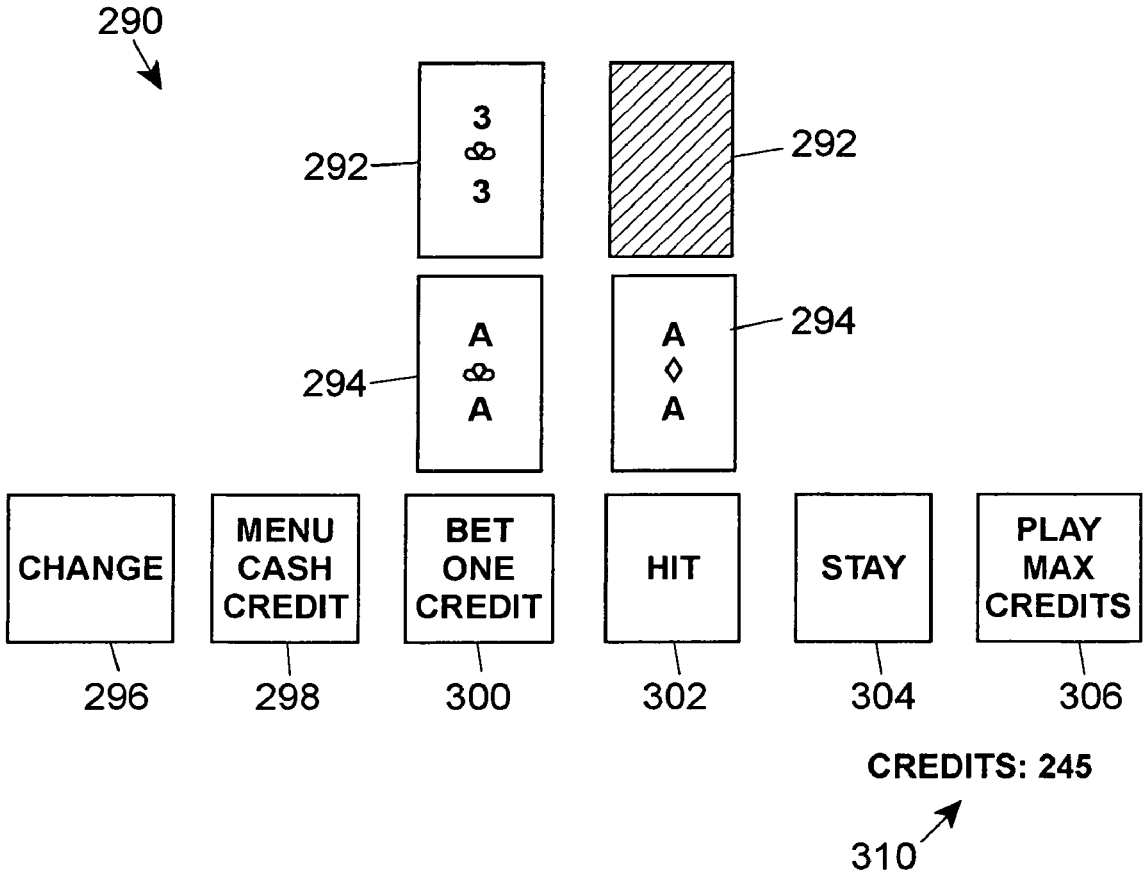
FIG. 9 is an exemplary illustration of graphics that may be displayed on the display unit when the controller of FIG. 2 executes the play video blackjack game routine of FIG. 8.

As shown in FIG. 9, an exemplary video display 290, which may be associated with the play video blackjack game routine 112, may include video images that represent a plurality of cards 292 that form a dealer's hand of cards and a plurality of cards 294 that form the user's hand of cards. To allow the user to control the play of the video blackjack game, a plurality of button graphics may be displayed. In particular, button graphics for change 296, menu/cash/credit 298 and bet one credit 300 may be displayed. Further, button graphics for hit 302, stay 304 and play max credits 306, as shown in FIG. 9 may also be provided. As noted with respect to FIGS. 5 and 7, the touch-sensitive input device 30 may be a touch screen that may be disposed over the display unit 24. Accordingly, each of the button graphics 296-306 may be associated with a particular area of the touch-sensitive input device 30 that is located between the display unit 24 and the user. A graphic representing the number of credits 310 may also be displayed to inform the user of the number of credits that he or she has remaining.

Video Keno

Figure 10:
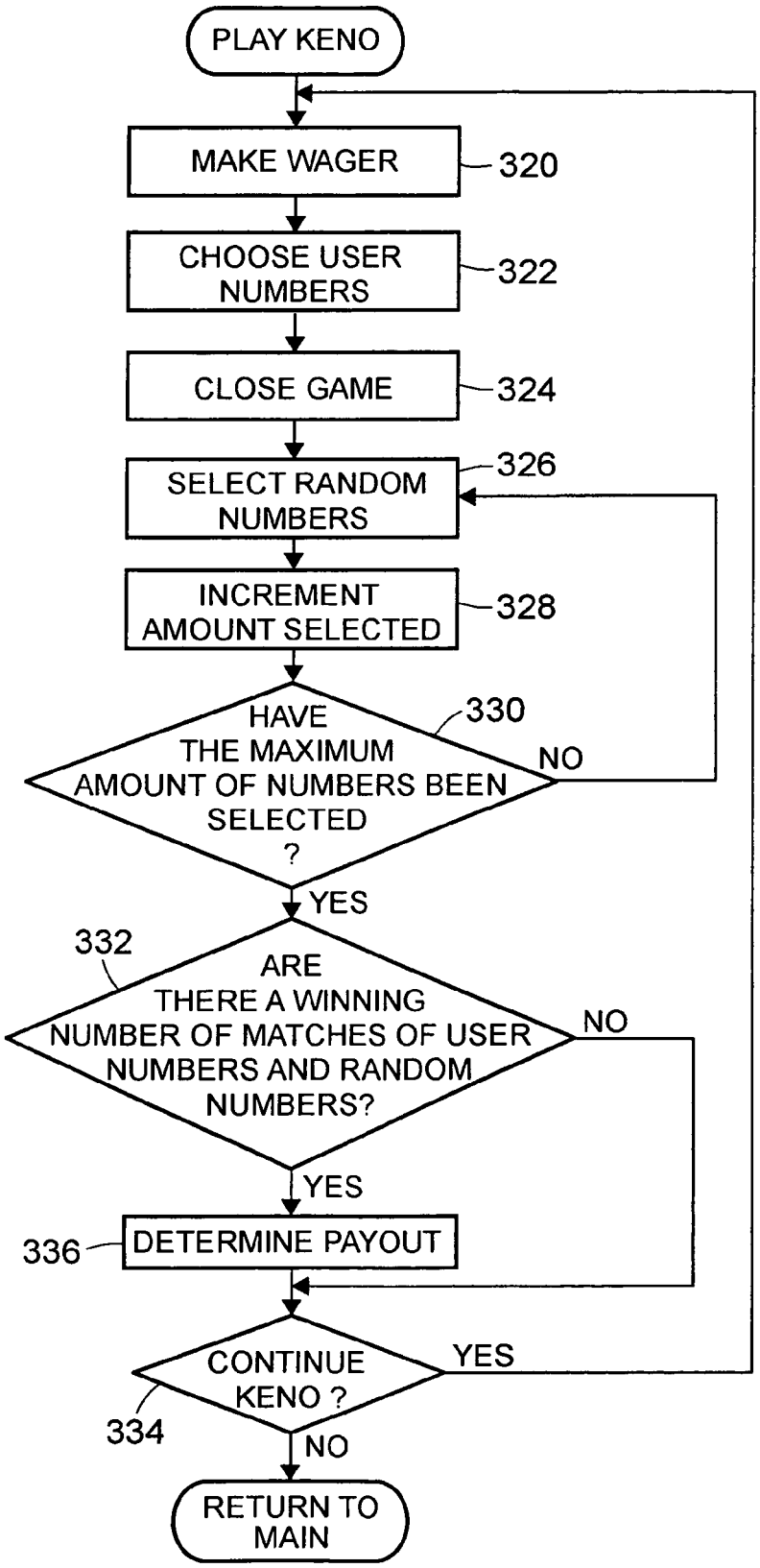
FIG. 10 is an exemplary flow diagram of a play keno game routine that may be implemented by the controller of FIG. 2.

When a user desires to play a video keno game, a play video keno game routine 113, as shown in FIG. 10, is executed. The routine 113 includes a number of blocks that may be embodied in software instructions stored in the memory 36 (FIG. 2). The execution of the play video keno routine 113 may begin at a block 320 at which a user makes a wager on the outcome of the keno game. After the user has made a wager, at a block 322, a user may select user numbers. The user numbers may be within a range set by the gaming establishment. The user may select more than one user number and there may be a maximum amount of user selections the user may make in a single game. Once the user has selected one or more user numbers, the selected user numbers are stored and control passes to a block 324.

At the block 324, after a certain amount of time, the game may close and no more user numbers are stored. After the execution of the block 324, a block 326 may select random numbers within the range set by the gaming establishment.

The selected random number may be communicated to the display device 24 and several other display devices placed throughout the gaming establishment. After the execution of the block 326, a block 328 may increment the count of random numbers that have been selected.

After the block 328 has executed, a block 330 may determine whether the maximum number of random numbers have been selected. If the maximum number of random numbers has not been selected, control may pass to the block 326 to allow another random number to be selected. If the maximum number of random numbers has been selected, control may pass to a block 332. The block 332 may determine whether there are a sufficient number of matches between the user numbers selected by the user and the random numbers selected. The sufficient number of matches may depend on the amount of numbers the user selected and the rules for the specific gaming establishment.

If a sufficient number of matches has not been identified, control may passes to a block 334. If a sufficient number of matches has been identified, control may pass to a block 336 where a payout is determined. The payout may depend on the amount of matched numbers for the user. Upon the completion of the block 336, control passes to the block 334 where it is determined whether the user desires to play another game of keno. If the user desires to play keno again, control passes to the block 320. Alternatively, if the user does not desire to play keno again, control passes to the block 116 of the main routine 100 of FIG. 3.

Figure 11:
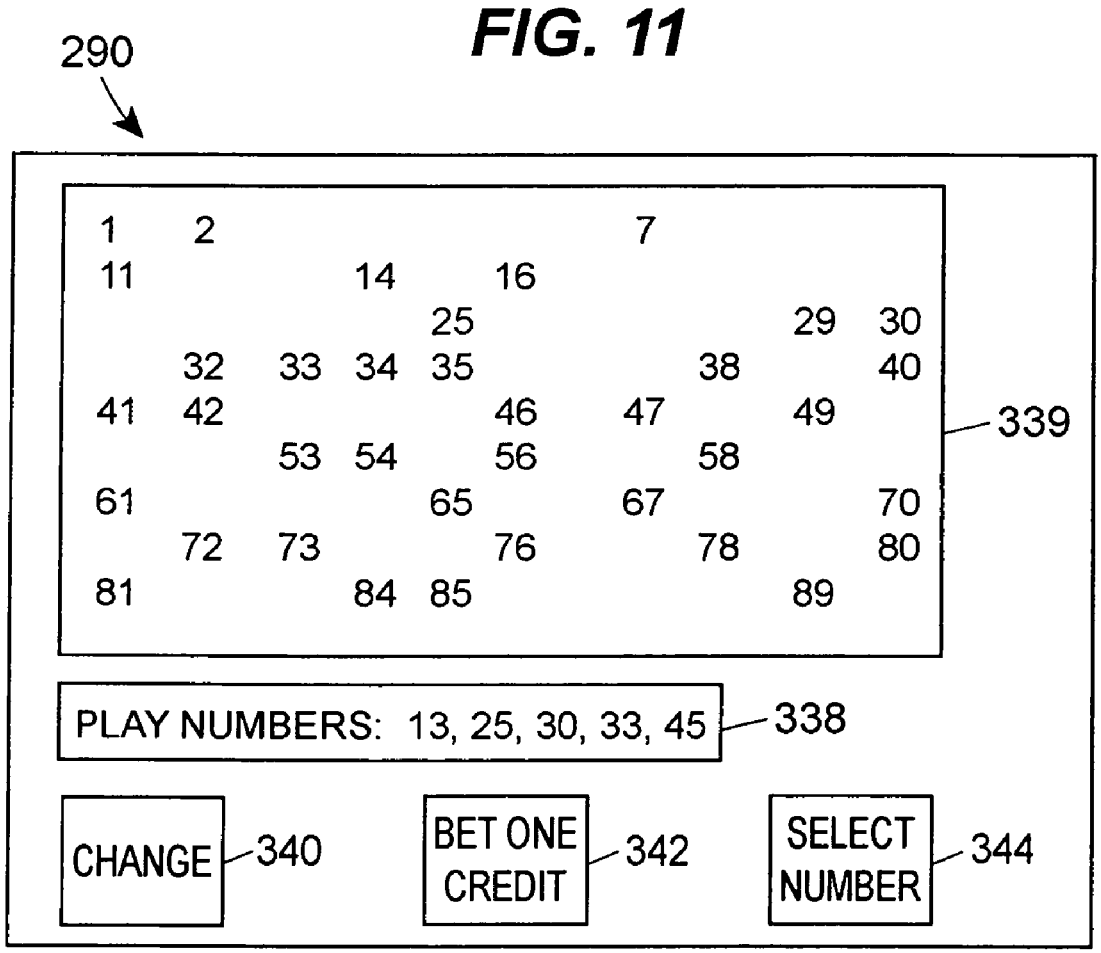
FIG. 11 is an exemplary illustration of graphics that may be displayed on the display unit when the controller of FIG. 2 executes the play keno game routine of FIG. 10.

As shown in FIG. 11, an exemplary video display 290, which may be associated with the play video keno game routine 113, may include video images that represent a plurality of numbers that are the selected user numbers 338 and the video images may represent the random numbers 339 selected during the game. The random numbers selected 339 may be displayed in a grid pattern. To allow the user to control the play of the video keno game, a plurality of button graphics may be displayed. In particular, button graphics for change 340, bet one credit 342 and select number 344 may be displayed. As noted with respect to FIGS. 5, 7 and 9, the touch-sensitive input device 30 may be a touch screen that may be disposed over the display unit 24. Accordingly, each of the button graphics 340-344 may be associated with a particular area of the touch-sensitive input device 30 that is located between the display unit 24 and the user. A graphic representing the number of credits 346 may also be displayed to inform the user of the number of credits that he or she has remaining.

Video Bingo

Figure 12:
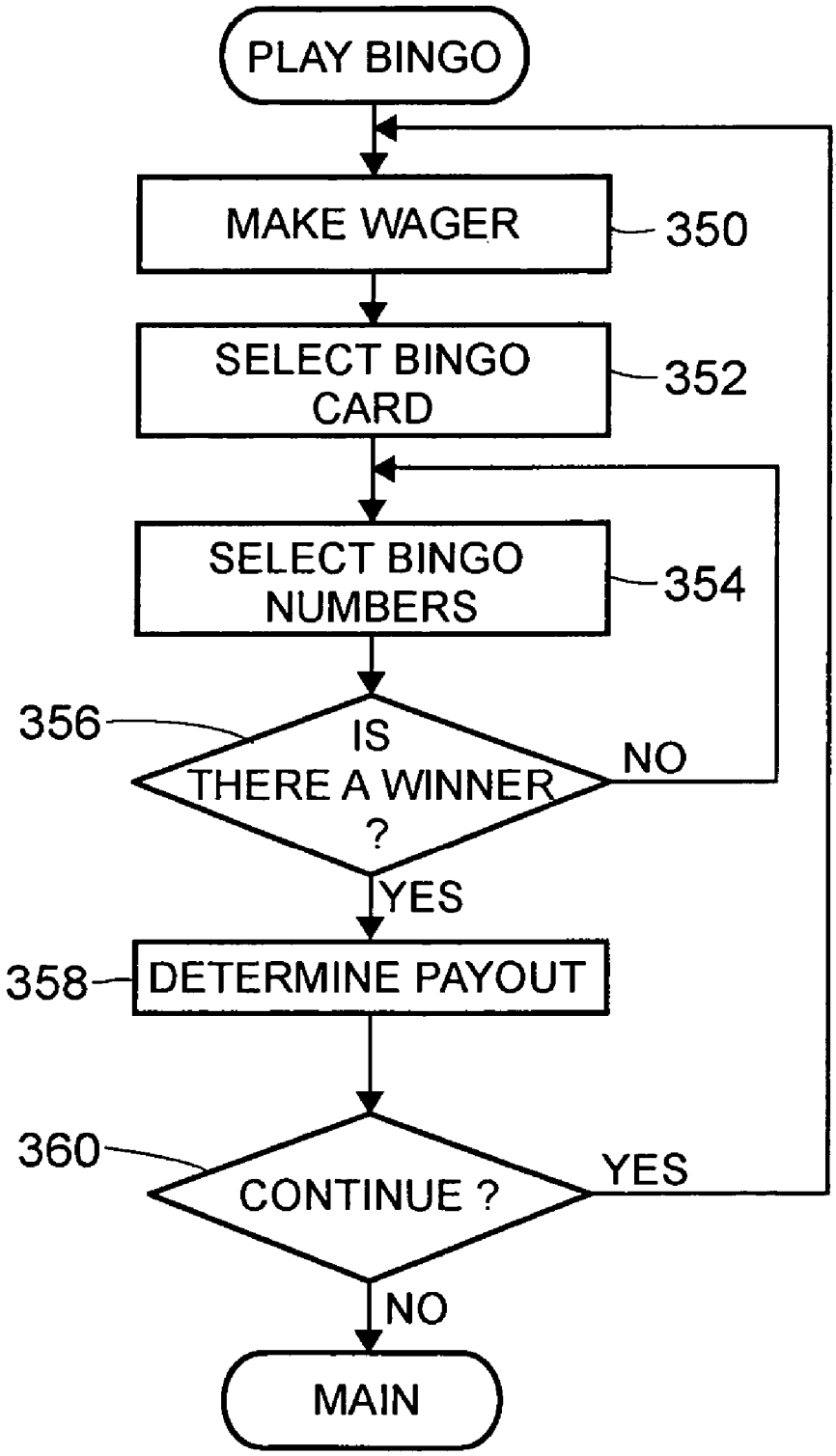
FIG. 12 is an exemplary flow diagram of a play bingo game routine that may be implemented by the controller of FIG. 2.

When a user desires to play a video bingo game, a play video bingo game routine 114, as shown in FIG. 12, is executed. The routine 114 includes a number of blocks that may be embodied in software instructions stored in the memory 36 (FIG. 2). The execution of the routine 114 may begin at a block 350 at which a user makes a wager on the outcome of the bingo game. After the user has made a wager, at a block 352, a user may select a playing card. The playing card also may be generated randomly. The user may select more than one playing card and there may be a maximum number playing cards a user may have in a single game. Once a user has selected one or more playing cards, control passes to a block 354.

At the block 354, random bingo numbers are generated. The bingo number generated may be communicated to the display device 24 and several other display devices placed throughout the gaming establishment. After the execution of the block 354, a block 356 may determine whether a player has won bingo according to the rules of bingo applicable at the particular gaming establishment. If no players have bingo, control may pass to the block 354 to allow another bingo number to be selected. If a user has bingo, control may pass to a block 358. The block 358 may determine the payout for the winner. The payout may depend on the number of random numbers that were drawn before there was a bingo winner, the total number of winners (if there is more than one player) and the amount of money that was wagered on the game. Upon the completion of the block 358, control passes to a block 360 where it is determined whether the user desires to play another game of bingo. If the user desires to play bingo again, control passes to the block 350. Alternatively, if the user does not desire to play bingo again, control passes to the block 116 of the main routine 100 of FIG. 3.

Figure 13:
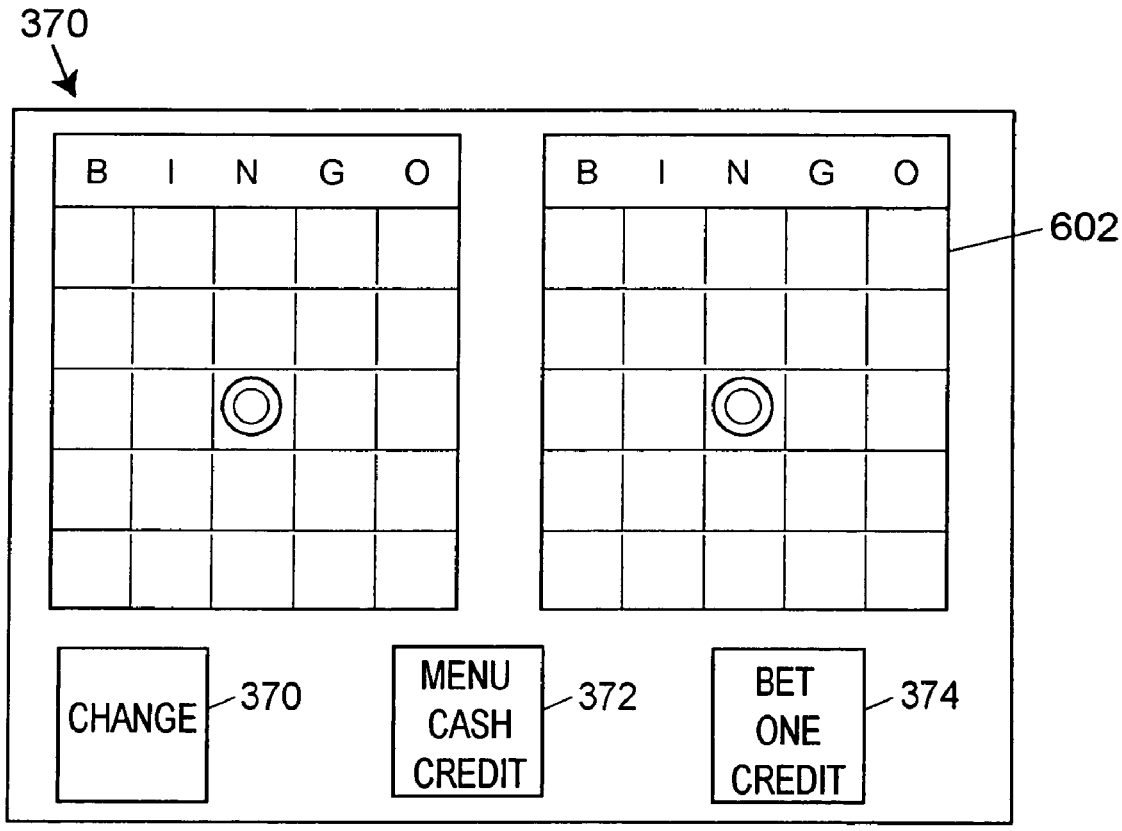
FIG. 13 is an exemplary illustration of graphics that may be displayed on the display unit when the controller of FIG. 2 executes the play bingo game routine of FIG. 12.

As shown in FIG. 13, an exemplary video display 370, which may be associated with the play video bingo game routine 114, may include video images that represent a plurality of bingo cards that are the selected by a user and the video images may represent the bingo numbers selected during the game. The bingo cards may have a gird pattern. To allow the user to control the play of the video bingo game, a plurality of button graphics may be displayed. In particular, button graphics for change 370, menu/cash/credit 372 and bet one credit 374 may be displayed. As noted with respect to FIGS. 5, 7, 9 and 11, the touch-sensitive input device 30 may be a touch screen that may be disposed over the display unit 24. Accordingly, each of the button graphics 370-374 may be associated with a particular area of the touch-sensitive input device 30 that is located between the display unit 24 and the user. A graphic representing the number of credits 376 may also be displayed to inform the user of the number of credits that he or she has remaining.

Game Adjustment in Response to Time Changes

Figure 14:
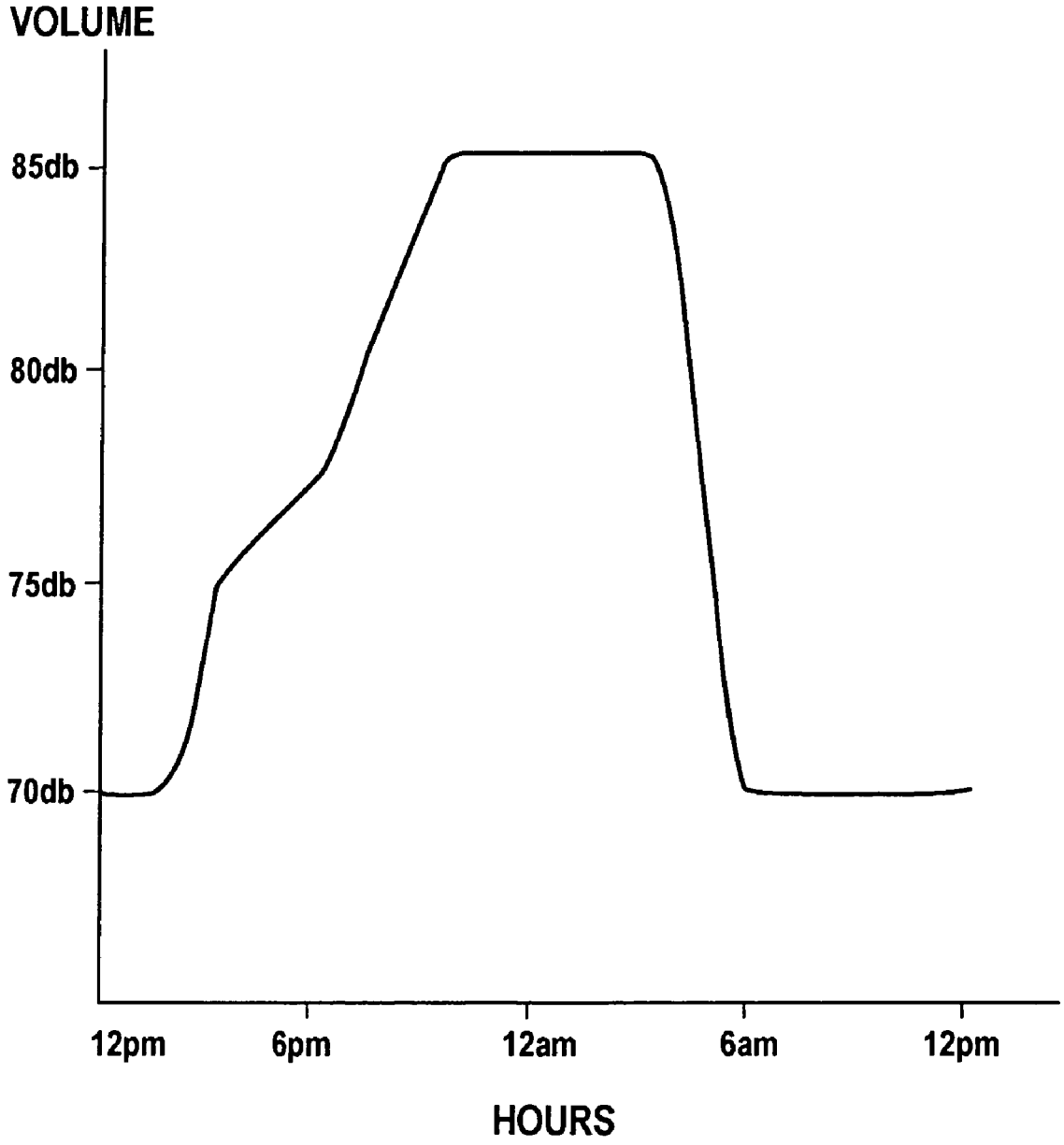
FIG. 14 is an exemplary graph illustrating results of a volume change in response to hours of time routine that may be implemented by the controller of FIG. 2.
Figure 15:
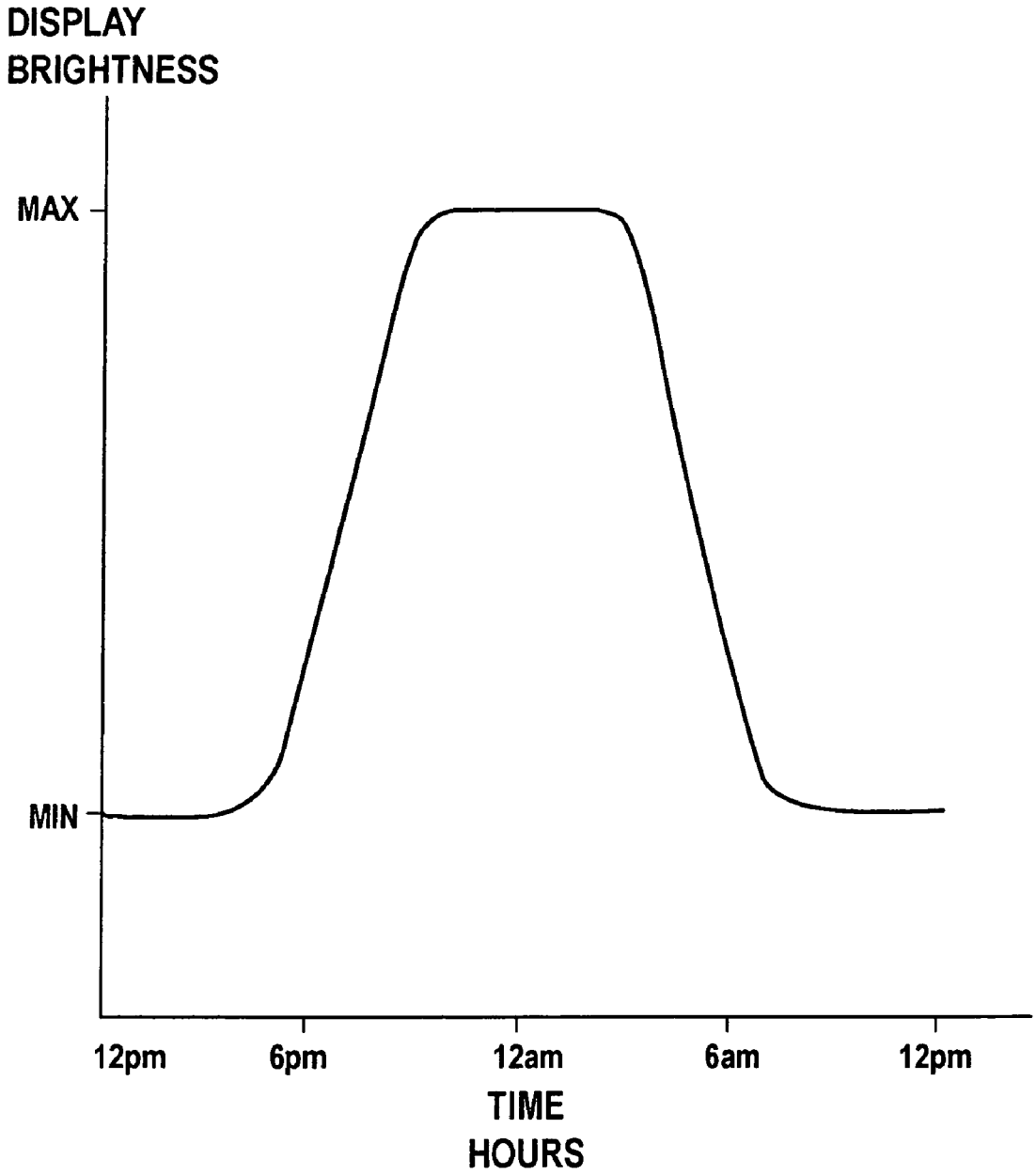
FIG. 15 is an exemplary graph illustrating results of a display brightness change in response to hours of time routine that may be implemented by the controller of FIG. 2.

The time generator 12 may be an internal clock that communicates a time signal to the controller 32. The time generator 12 also may be a time signal received from a network external to the gaming unit to which the gaming unit is in communication. The time signal may represent the current time and may include a year, a month, a day, an hour, a minute and a second all of which may be represented by a single time signal. The controller 32 may be programmed to perform a game adaption in response to the time signal. For example, the volume of the game may be varied in response to the time signal as illustrated in FIG. 14. Accordingly, the volume may be increased during the peak hours of activity within a gaming establishment which may be between 9 pm and 4 am and which may attract the attention of more users. Further, as illustrated in FIG. 15, the brightness of the display device 24 may be varied in response to the time signal. For example, the hours 6 pm to 6 am may be the busiest for a gaming establishment and more attention to the gaming unit may be created by increasing the brightness on the display device 24 on the gaming units 10. Related, when there are less people in the gaming establishment, the brightness on the gaming unit 10 can be reduced because the attention of the game player will not be as difficult to obtain.

Figure 16:
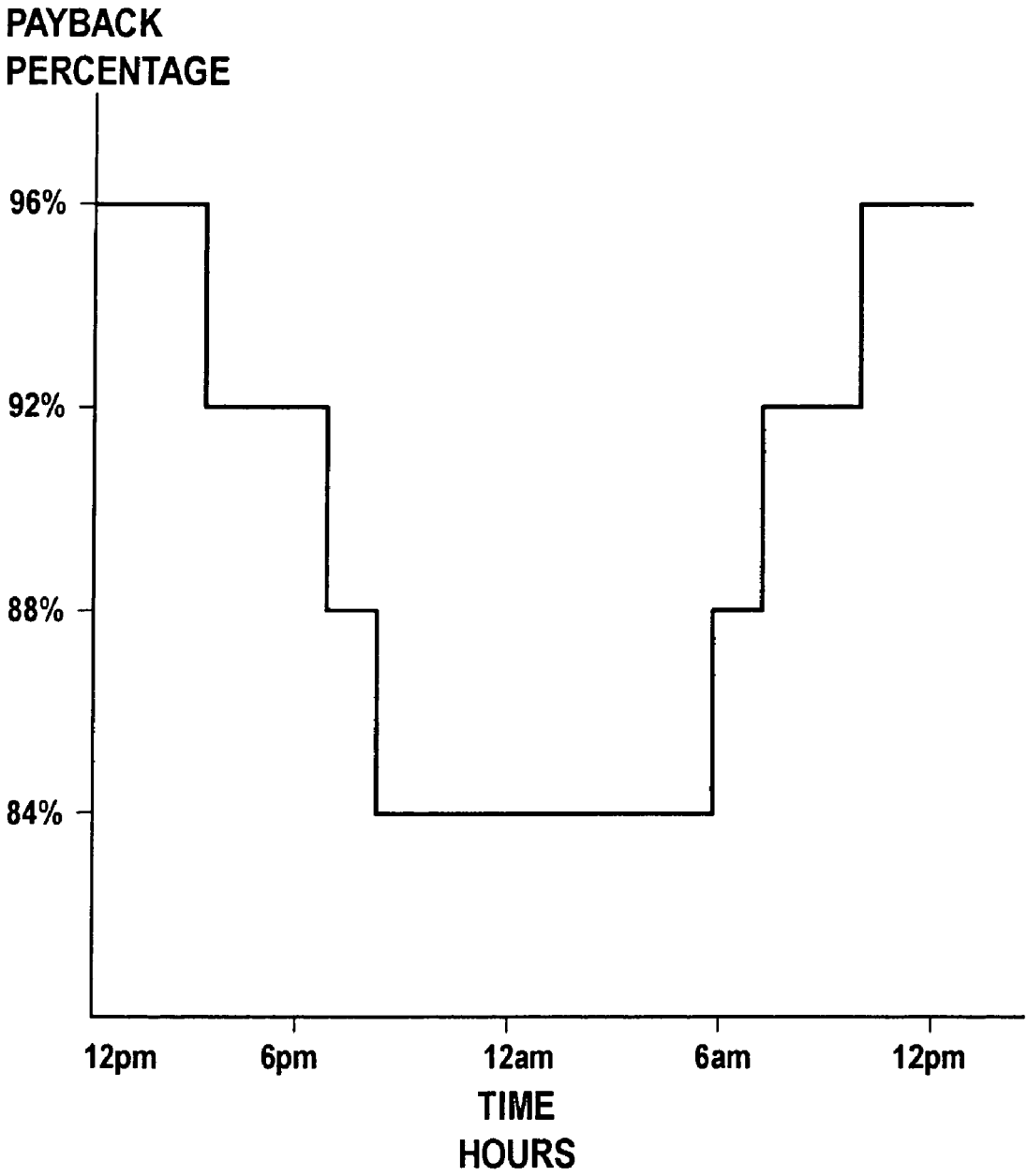
FIG. 16 is an exemplary graph illustrating results of a payback percentage change in response to hours of time routine that may be implemented by the controller of FIG. 2.
Figure 17:
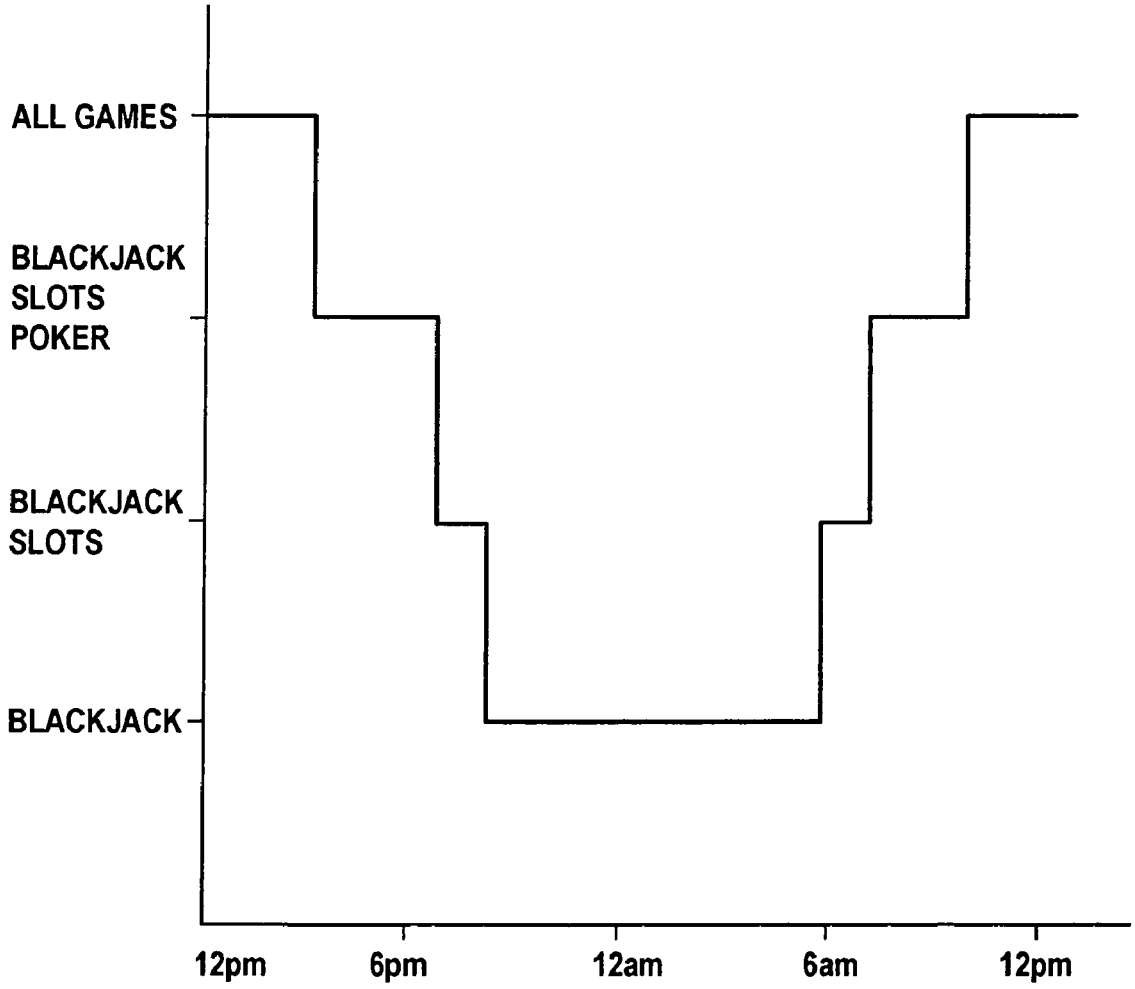
FIG. 17 is an exemplary graph illustrating results of a game available change in response to hours of time routine that may be implemented by the controller of FIG. 2.

In another example as illustrated in FIG. 16, the payout percentage may be varied in response to the time signal. For example, the payout percentage may be at a minimum during the busiest time for the gaming establishment because the gaming establishments do not have to have large payout percentages to attract customers. However, payout percentages may be raised to attract more players during periods of slow play. In yet another example illustrated in FIG. 17, the games that are available to be played may be varied in response to the time signal. For example, the game blackjack may be the most profitable for a gaming establishment and poker may be the least profitable and the hours between 7 pm and 5 am may be when the casino is most busy. When the gaming establishment is busy and demand for gaming units is high, the gaming establishment may want to restrict the gaming unit 10 to play only the most profitable game which may be blackjack. However, when the gaming establishment is not busy, other games which may be less profitable may be added to the gaming unit 10 to attract more customers.

Figure 18:
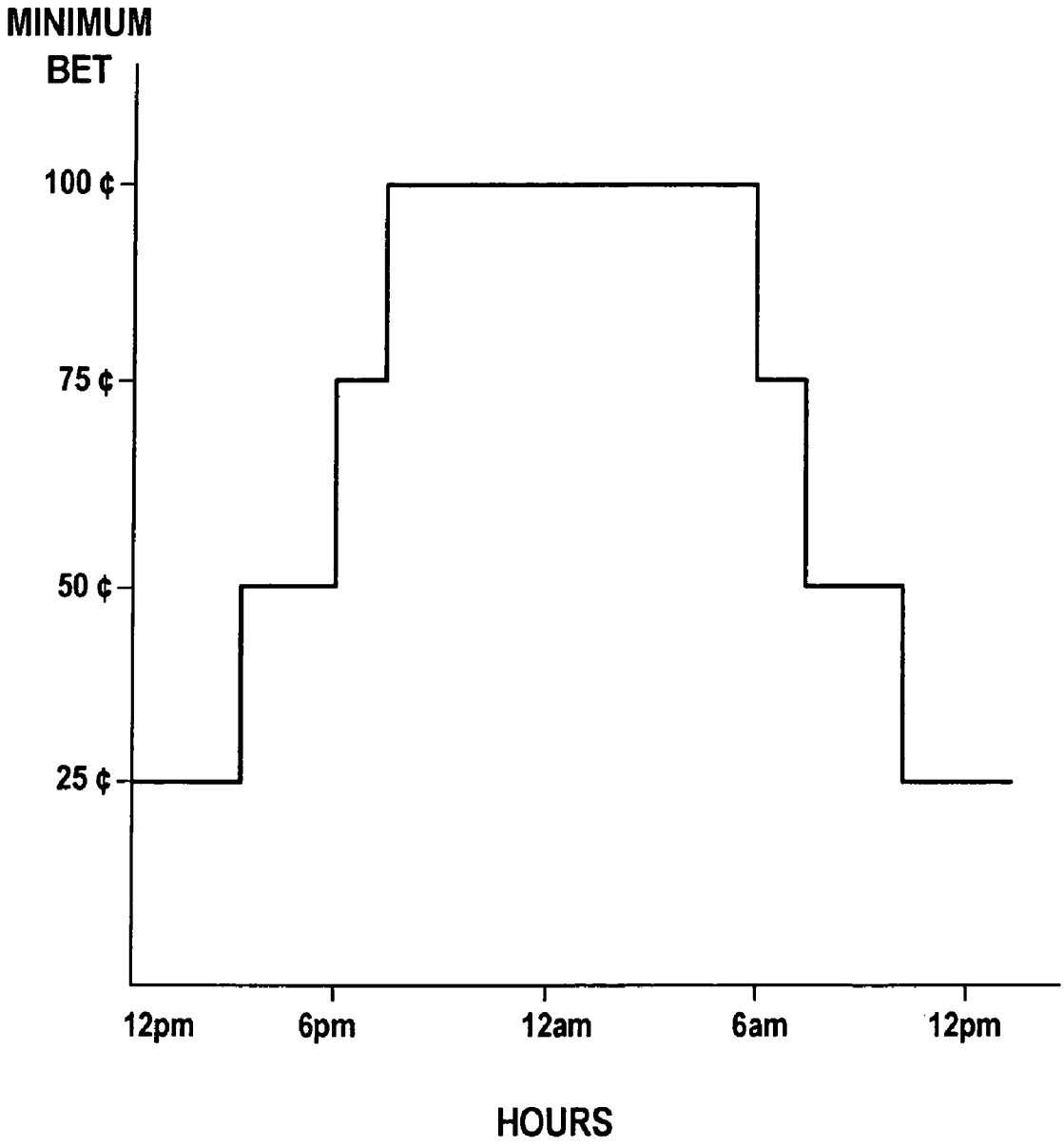
FIG. 18 is an exemplary graph illustrating results of a minimum bet change in response to hours of time routine that may be implemented by the controller of FIG. 2.

In yet another example as illustrated in FIG. 18, the minimum bet for a gaming unit 10 can be adjusted in response to the time signal. For example, a gaming establishment may be most busy between 7 pm and 5 am. Accordingly, the minimum bet size may be increased during the busy hours, allowing the gaming establishment to bring in additional revenue. In addition, the minimum bet may be lowered during the hours when the gaming establishment may not be as busy to attract more users.

Figure 19:
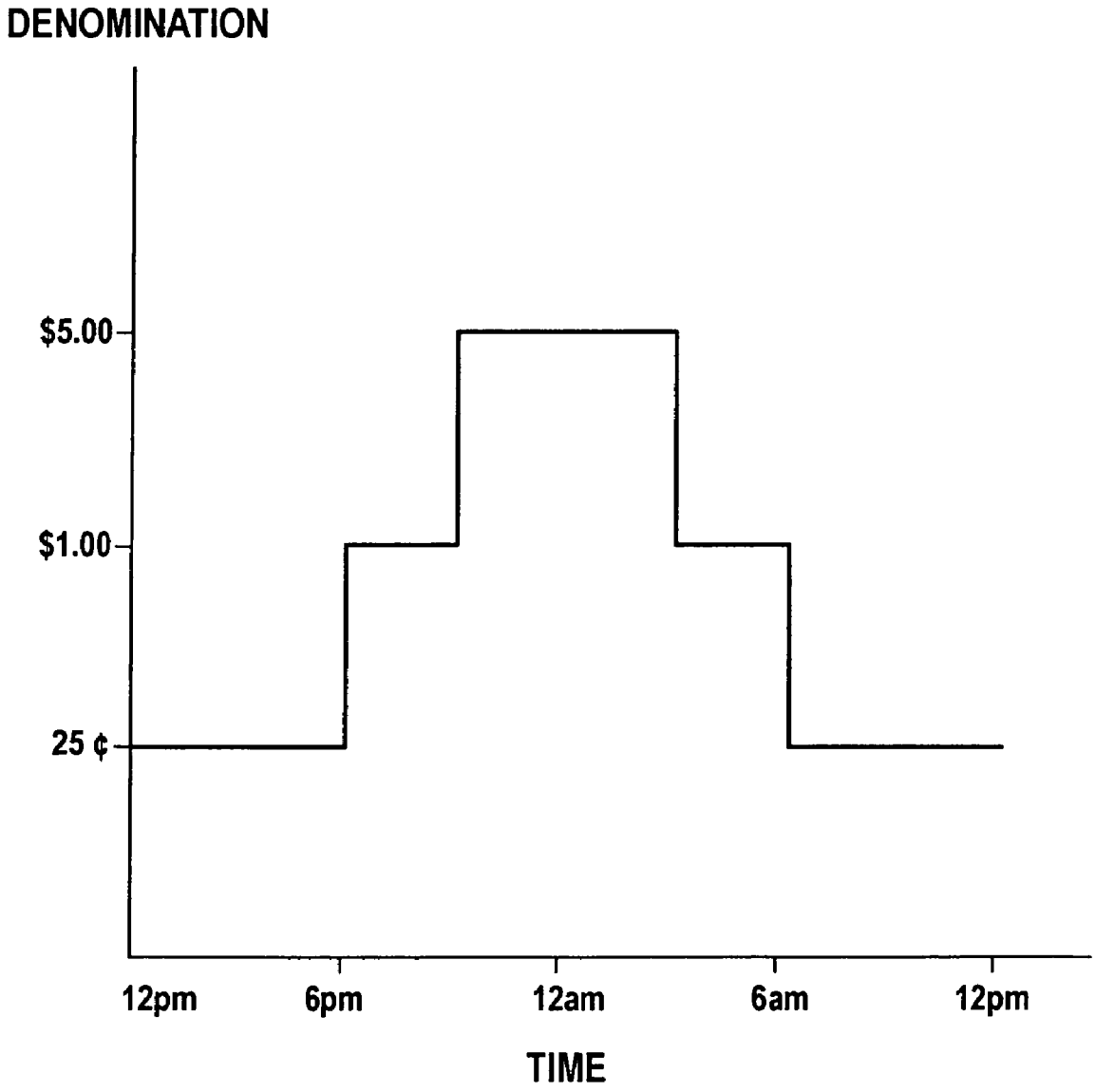
FIG. 19 is an exemplary graph illustrating results of a denomination change in response to hours of time routine that may be implemented by the controller of FIG. 2.

In another example as illustrated in FIG. 19, the denomination for a gaming unit 10 can be adjusted in response to the time signal. For example, a gaming establishment may be most busy between 9 pm and 3 am. Accordingly, the denomination or amount required to start a game may be increased during the busy hours, allowing the gaming establishment to bring in additional revenue. In addition, the denomination may be lowered during the hours when the gaming establishment may not be as busy to attract more users.

Figure 20:
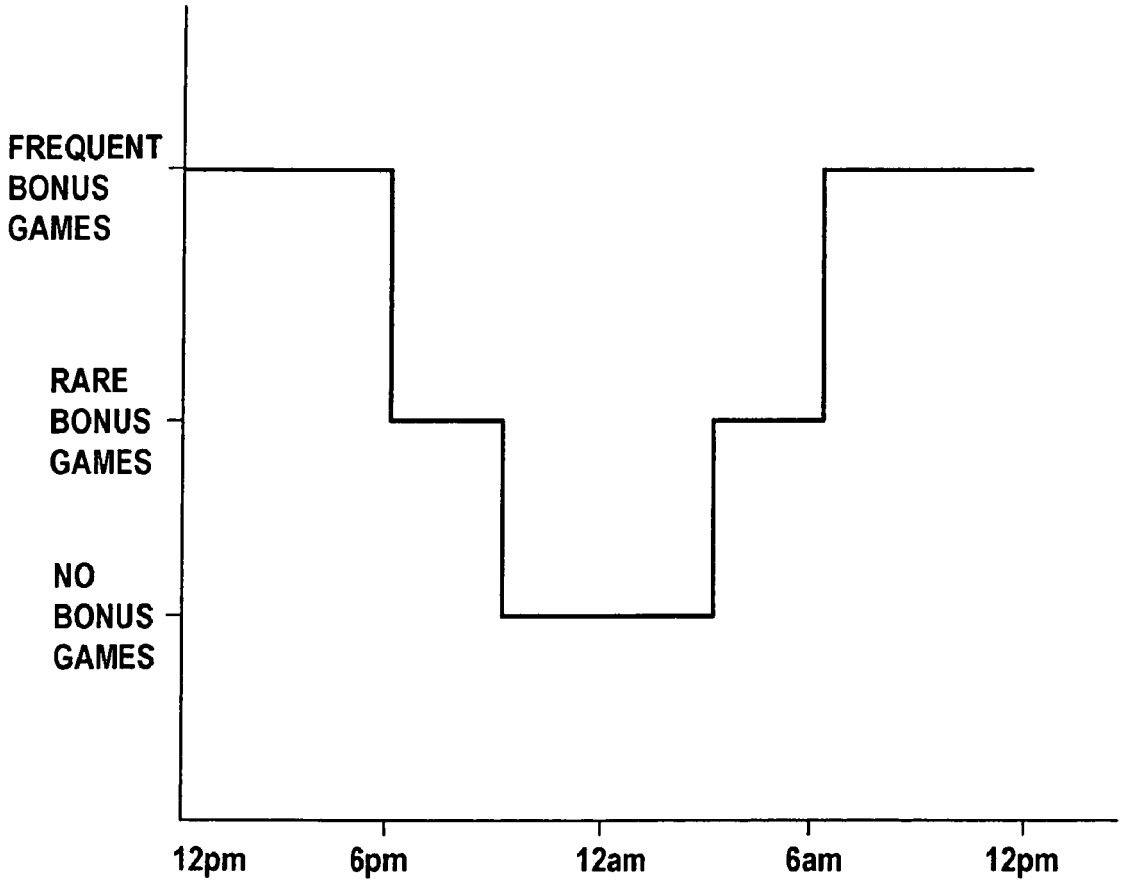
FIG. 20 is an exemplary graph illustrating results of a frequency of bonus game availability change in response to hours of time routine that may be implemented by the controller of FIG. 2.

In yet another example as illustrated in FIG. 20, the frequency of bonus games for a gaming unit 10 can be adjusted in response to the time signal. For example, a gaming establishment may be most busy between 9 pm and 3 am. Accordingly, the frequency of bonus games may be lowered during the busy hours, allowing the gaming establishment to bring in additional revenue. In addition, the frequency of bonus games may be increased during the hours when the gaming establishment may not be as busy to attract more users.

Figure 21:
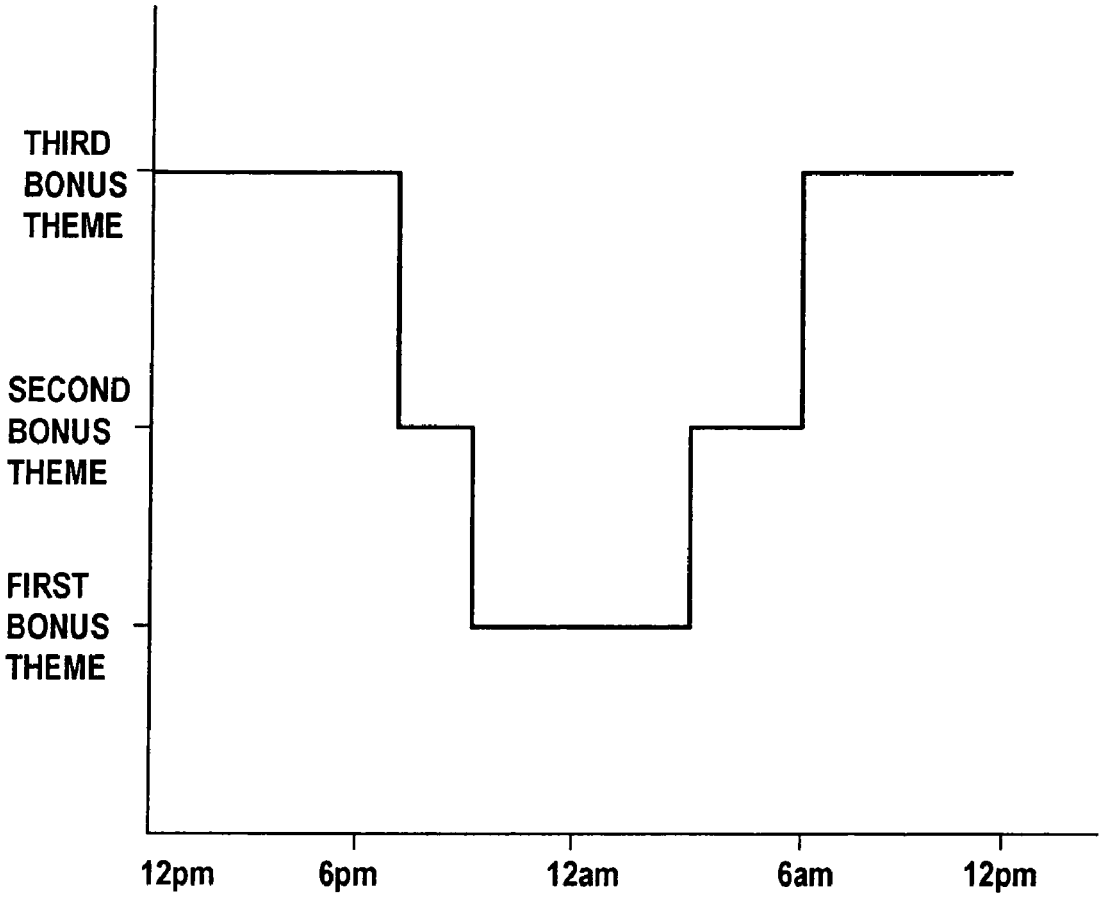
FIG. 21 is an exemplary graph illustrating results of a bonus games available change in response to hours of time routine that may be implemented by the controller of FIG. 2.

In yet another example as illustrated in FIG. 21, the bonus game theme for a gaming unit 10 can be adjusted in response to the time signal. For example, a gaming establishment may be most busy between 9 pm and 3 am. Accordingly, the bonus theme may be a first bonus theme which pays a small bonus during the busy hours, allowing the gaming establishment to bring in additional revenue. In addition, the bonus theme may be a second bonus theme which pays a higher bonus during the hours when the gaming establishment may not be as busy to attract more users. The bonus game theme may also be adjusted to appeal to the preference of users who tend to gamble at a specific time. For example, novice users may tend to play between 7 pm and 9 pm and may be attracted to a "Wheel of Fortune" bonus game. Accordingly, the gaming unit 10 may be changed to highlight the "Wheel of Fortune" bonus game between 7 pm and 9 pm.

Figure 22:
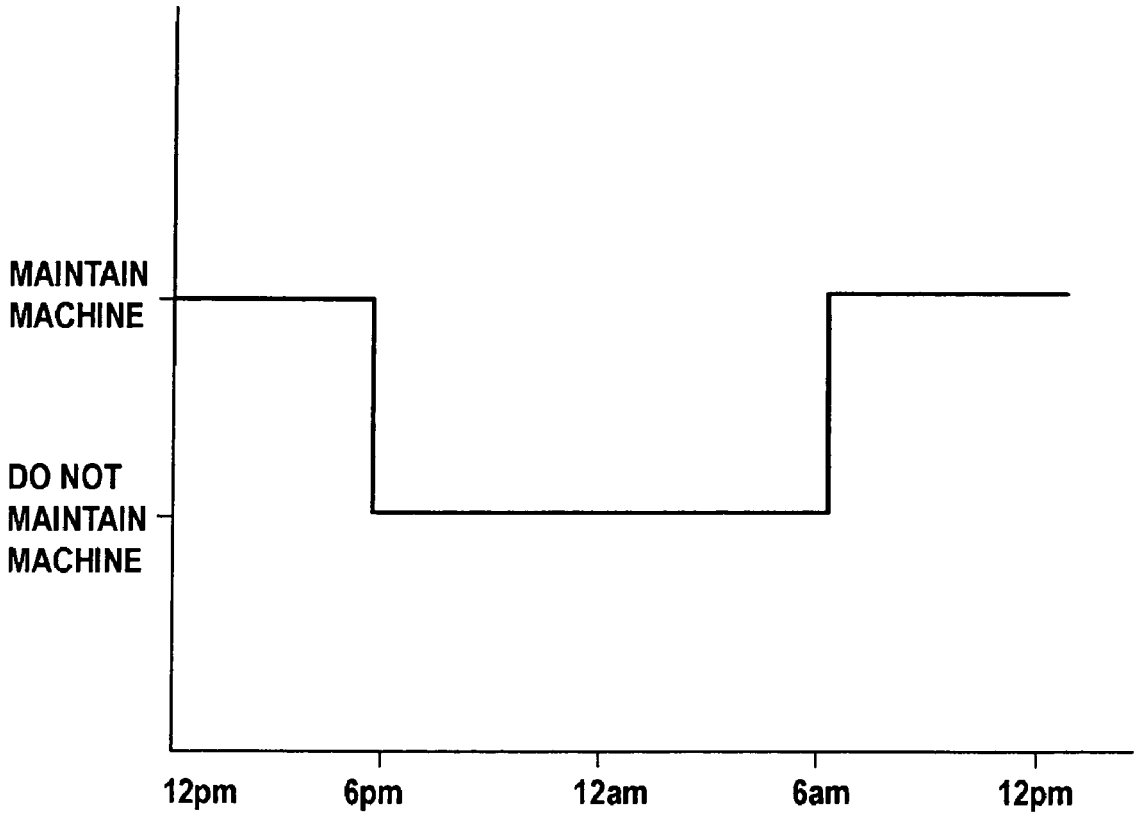
FIG. 22 is an exemplary graph illustrating results of a maintain machine in response to hours of time routine that may be implemented by the controller of FIG. 2.

In another example as illustrated in FIG. 22, maintenance for a gaming unit 10 can be adjusted in response to the time signal. For example, a gaming establishment may be most busy between 6 pm and 6 am. Accordingly, the gaming unit 10 may not be maintained during the busy hours, allowing the gaming establishment to bring in additional revenue. In addition, the gaming unit 10 may be maintained during the hours when the gaming establishment may not be as busy to attract more users.

Figure 23:
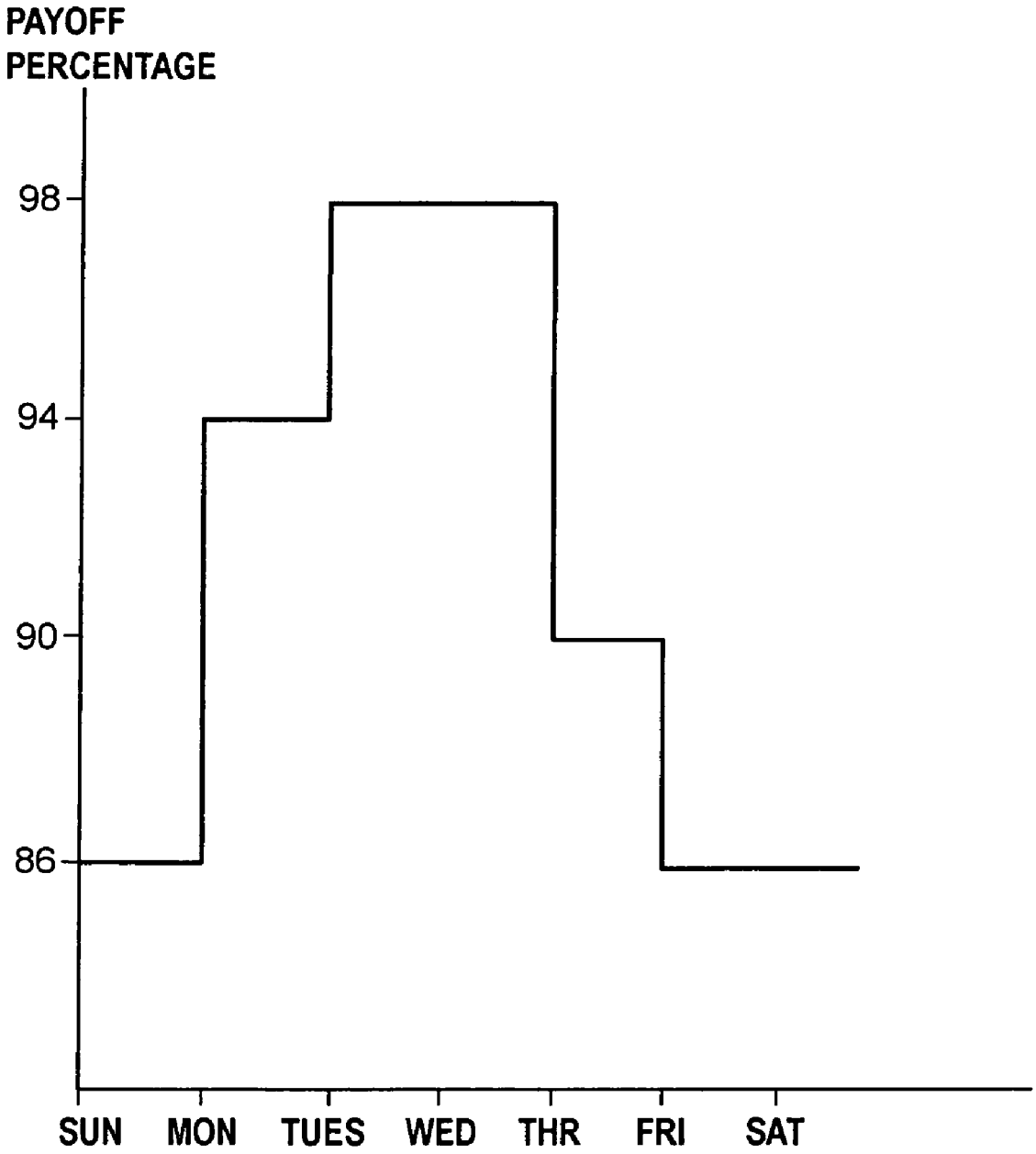
FIG. 23 is an exemplary graph illustrating results of a minimum payoff percentage change in response to days of time routine that may be implemented by the controller.

The games may be responsive to larger changes in time such as days rather than hours. For example as illustrated in FIG. 23, the gaming establishment may be more busy on Friday, Saturday and Sunday. Accordingly, a gaming establishment may pay out a lower percentage on these days because demand is higher and customer may not need to be lured to the gaming establishment with high payout percentages. In contrast, Tuesdays and Wednesdays may be slower days for gaming establishments and the payout percentages may be raised in an attempt to entice more users to the gaming establishment.

Figure 24:
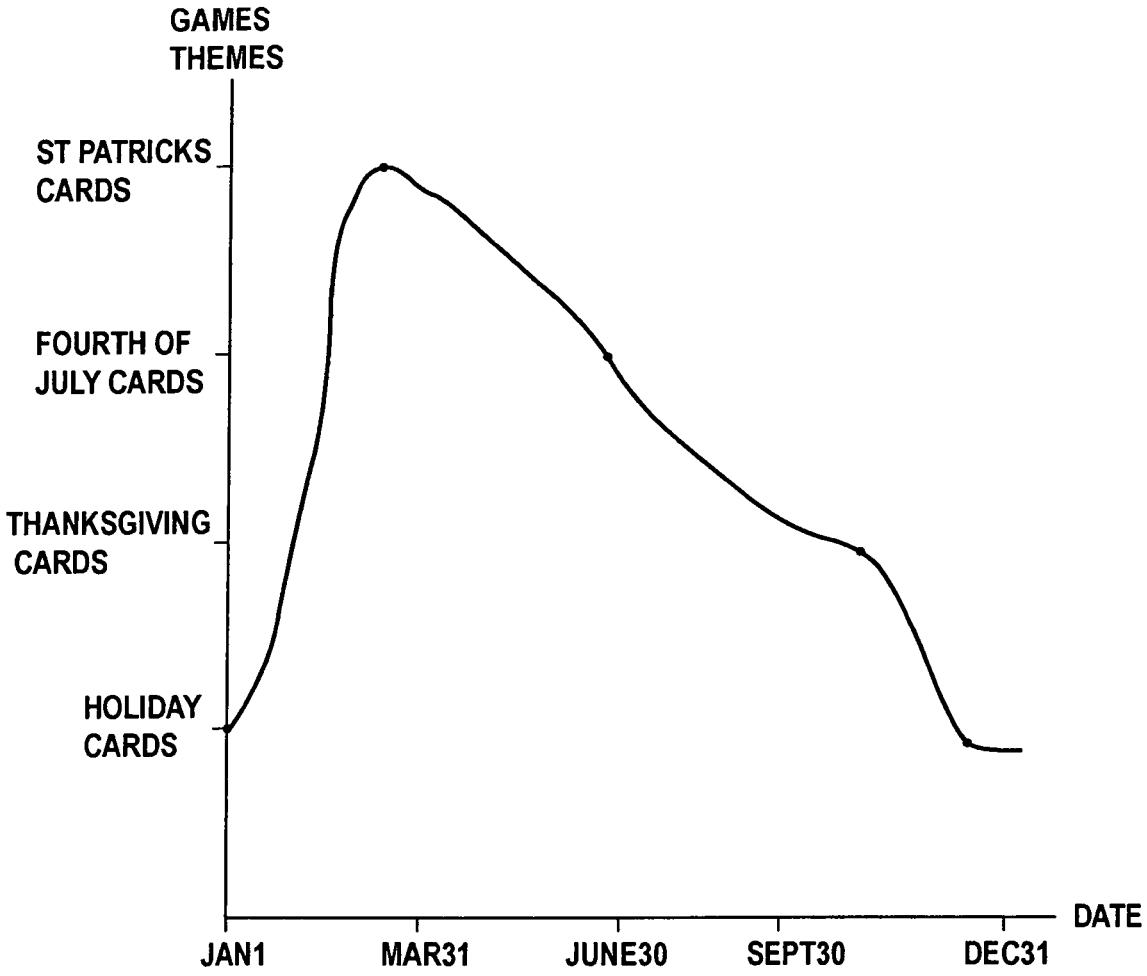
FIG. 24 is an exemplary graph illustrating results of a game theme change in response to days of time routine that may be implemented by the controller.

Further, even larger time changes can be the basis for changes in the game. For example as illustrated in FIG. 24, the theme on the back of playing cards displayed on the display unit 24 may be changed to reflect current events, seasons and holidays. For example, the back of the cards may signify the Christmas holiday season during the November through January period by placing a Christmas tree on the card backs. The back of the cards may then change to signify St. Patrick's Day during the month of March by placing a shamrock display on the card backs. During late June and early July, the back of the cards then may change to signify the Fourth of July by placing an American flag on the back of the cards. During November, the back of the cards may be changed to signify Thanksgiving by displaying a turkey on the card backs. Further, astrological symbols may be used to indicate the current astrological cycle which may draw user interest. All of these designs may cause greater interest by game players and may cause an increase in demand to use these gaming units 10. In addition, the background graphics, sounds and scents may be changed to better reflect the current events.

Figure 25:
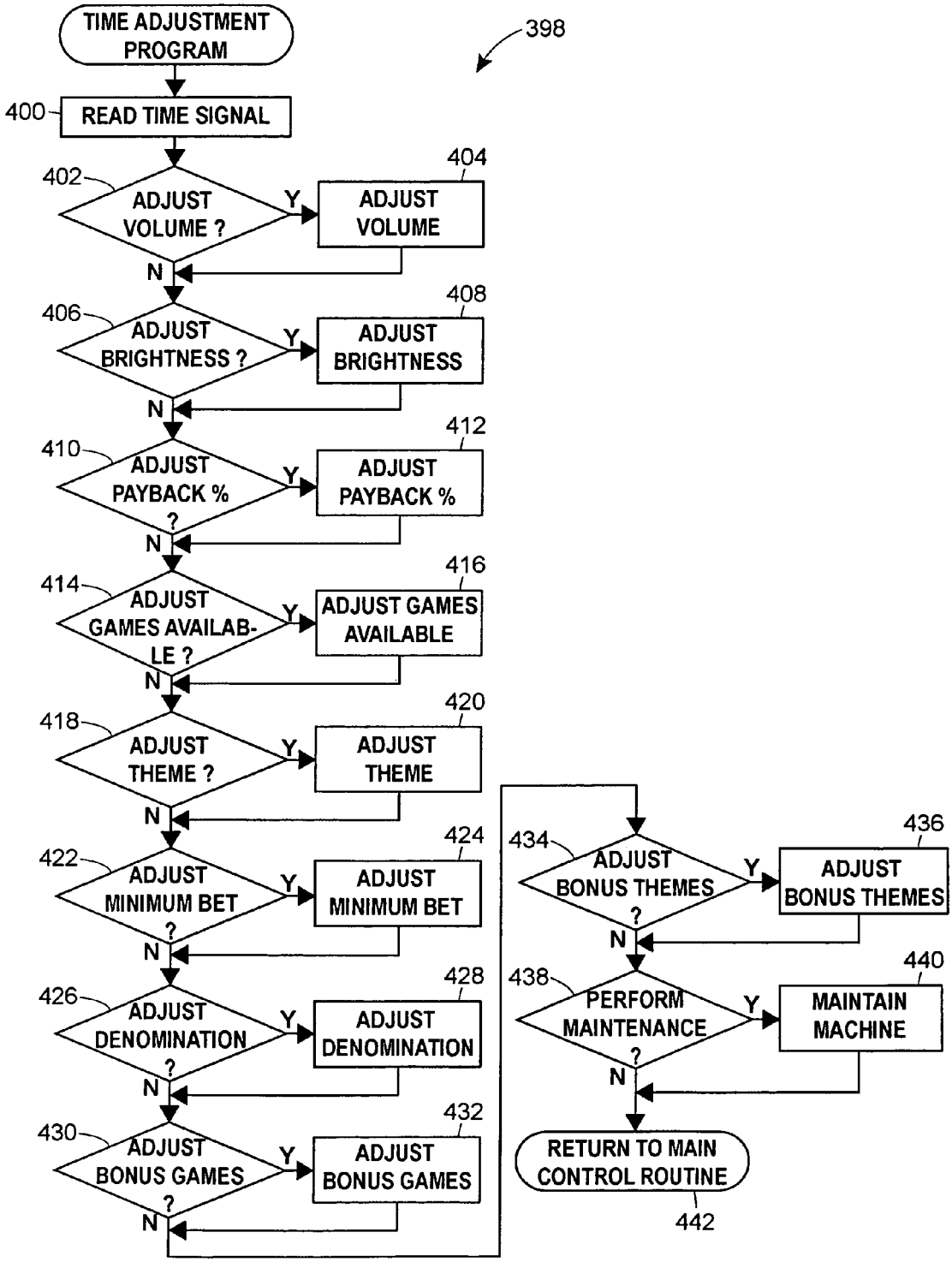
FIG. 25 is an exemplary flow diagram of a time adjustment program routine that may be implemented by the controller of FIG. 2.

Referring to FIG. 25, a time adjustment routine is illustrated. The routine 398 includes a number of blocks that may be embodied in software instructions stored in the memory 36 (FIG. 2). The execution of the routine 398 may begin at a block 400 at which the time signal is read. The time signal may be read at a set interval such as once a minute or may be part of an interrupt routine. As previously described, the time signal may be from an internal clock or from an external clock. After the time signal is read, a block 402 may determine whether the volume on the gaming unit 10 should be adjusted based on the time signal read. If it is determined that volume should be adjusted, control may pass to a block 404 where the volume is adjusted and control may then pass to a block 406. If it is determined that the volume should not be adjusted, control may pass to the block 406.

The block 406 may determine whether the brightness on the gaming unit 10 should be adjusted based on the time signal read. If it is determined that brightness should be adjusted, control may pass to a block 408 where the brightness is adjusted and control may then pass to a block 410. If it is determined that the brightness should not be adjusted, control may pass to the block 410.

The block 410 may determine whether the payback percentage on the gaming unit 10 should be adjusted based on the time signal read. If it is determined that payback percentage should be adjusted, control may pass to a block 412 where the payback percentage is adjusted and control may then pass to a block 414. If it is determined that the payback percentage should not be adjusted, control may pass to the block 414.

The block 414 may determine whether the games available on the gaming unit 10 should be adjusted based on the time signal read. If it is determined that the games available should be adjusted, control may pass to a block 416 where the games available are adjusted and control may then pass to a block 418. If it is determined that the games available should not be adjusted, control may pass to the block 418.

The block 418 may determine whether the theme on the gaming unit 10 should be adjusted based on the time signal read. If it is determined that the theme should be adjusted, control may pass to a block 420 where the theme is adjusted and control may then pass to a block 422. If it is determined that theme should not be adjusted, control may pass to the block 422.

The block 422 may determine whether the minimum bet on the gaming unit 10 should be adjusted based on the time signal read. If it is determined that the minimum bet should be adjusted, control may pass to a block 424 where the minimum bet is adjusted and control may then pass to a block 426. If it is determined that the minimum bet should not be adjusted, control may pass to the block 426.

The block 426 may determine whether the denomination on the gaming unit 10 should be adjusted based on the time signal read. If it is determined that the denomination should be adjusted, control may pass to a block 428 where the denomination is adjusted and control may then pass to a block 430. If it is determined that the denomination should not be adjusted, control may pass to the block 430.

The block 430 may determine whether the bonus games on the gaming unit 10 should be adjusted based on the time signal read. If it is determined that the bonus games should be adjusted, control may pass to a block 432 where the bonus games are adjusted and control may then pass to a block 434. If it is determined that bonus games should not be adjusted, control may pass to the block 434.

The block 434 may determine whether the bonus theme on the gaming unit 10 should be adjusted based on the time signal read. If it is determined that the bonus theme should be adjusted, control may pass to a block 436 where the bonus theme is adjusted and control may then pass to a block 438. If it is determined that the bonus theme should not be adjusted, control may pass to the block 438.

The block 438 may determine whether maintenance on the gaming unit 10 should be performed based on the time signal read. If it is determined that maintenance should be performed, control may pass to a block 440 where a maintenance signal is generated and control may then pass to the main control routine. If it is determined that maintenance should not be performed, control may pass the main control routine.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and related methods may be varied substantially without departing from the spirit of the invention, and the exclusive use of all modifications which come within the scope of the appended claims is reserved.

What is claimed is:

1. An electronic gaming unit for play of a gambling game, the electronic gaming unit comprising:

a display unit configured to generate images;

an internal time generator configured to generate an internal time signal indicative of a time of day;

an input device configured to receive input;

a currency accepting mechanism configured to accept a medium of currency; and a controller operatively coupled to the display unit, the time generator and the input device, the controller comprising a processor and a memory operatively coupled to the processor, the controller being programmed to:

receive a signal from the input device indicating the gambling game to be played from a selection of gambling games available to be played, wherein the signal is generated in response to input;

display a sequence of images on the display unit, the sequence of images representing the selected gambling game;

receive the time signal from the time generator when the electronic gaming unit is operational;

change the selection of gambling games available to be played in response to the time signal when the electronic gaming unit is operational, thereby changing the selection of gambling games available to be played by the controller without requiring additional input;

change a minimum bet to be inputted via the input device for the selected gambling game in response to the time signal when the electronic gaming unit is operational, thereby changing the minimum bet by the controller without requiring additional input;

change a payout percentage for the electronic gaming unit in response to the time signal when the electronic gaming unit is operational, thereby changing the payout percentage by the controller without requiring additional input;

change a brightness of the display unit in response to the time signal when the electronic gaming unit is operational, thereby changing the brightness by the controller without requiring additional input;

change a theme of the selected gambling game in response to the time signal when the electronic gaming unit is operational, thereby changing the theme by the controller without requiring additional input;

determine, after the sequence of images has been displayed, an outcome of the selected gambling game represented by the sequence of images; and determine a currency payout associated with the outcome of the selected gambling game.

2. The electronic gaming unit of claim 1 additionally comprising an audio speaker and wherein the controller is programmed to change a volume emitted from the speaker in response to the time signal.

3. The electronic gaming unit of claim 1 wherein the controller is programmed to change a denomination for the medium of currency required to begin the selected gambling game in response to the time signal.

4. The electronic gaming unit of claim 1 wherein the controller is programmed to replace a first available bonus game for a second available bonus game in response to the time signal.

5. The electronic gaming unit of claim 4 wherein the first available bonus game is associated with a first potential payout and the second available bonus game is associated with a second potential payout.

6. The electronic gaming unit of claim 1 wherein the controller is programmed to change a maintenance schedule of the gaming unit in response to the time signal.

7. An electronic gaming unit for play of a gambling game, the electronic gaming unit comprising:

a display unit configured to generate images;

a time generator configured to generate a time signal indicative of a time of day;

an input device configured to receive input;

a currency accepting mechanism configured to accept a medium of currency; and a controller operatively coupled to the display unit, the time generator and the input device, the controller comprising a processor and a memory operatively coupled to the processor, the controller being programmed to:

receive a signal from the input device indicating the gambling game to be played from a selection of gambling games available to be played, wherein the signal is generated in response to input;

display a sequence of images on the display unit, the sequence of images representing the selected gambling game;

change the selection of gambling games available to be played in response to the time signal;

change a denomination for the medium of currency required to begin the selected gambling game in response to the time signal;

determine, after the sequence of images has been displayed, an outcome of the selected gambling game represented by the sequence of images; and determine a currency payout associated with the outcome of the selected gambling game.

8. The electronic gaming unit of claim 7 wherein the time generator comprises an internal clock configured to generate the time signal.

9. The electronic gaming unit of claim 7 wherein the time generator is configured to receive the time signal from a location external to the gaming unit.

10. The electronic gaming unit of claim 7 additionally comprising an audio speaker and wherein the controller is programmed to change a volume emitted from the speaker in response to the time signal.

11. The electronic gaming unit of claim 7 wherein the controller is programmed to change a payout percentage in response to the time signal.

12. The electronic gaming unit of claim 7 wherein the controller is programmed to change a brightness of the display unit in response to the time signal.

13. The electronic gaming unit of claim 7 wherein the controller is programmed to change a theme of the selected gambling game in response to the time signal.

14. The electronic gaming unit of claim 7 wherein the controller is programmed to change a frequency of occurrence of a bonus game in response to the time signal.

15. The electronic gaming unit of claim 7 wherein the controller is programmed to replace a first available bonus game for a second available bonus game in response to the time signal.

16. The electronic gaming unit of claim 15 wherein the first available bonus game is associated with a first potential payout and the second available bonus game is associated with a second potential payout.

17. The electronic gaming unit of claim 7 wherein the controller is programmed to change a maintenance schedule of the gaming unit in response to the time signal.

18. An electronic gaming unit for play of a gambling game, the electronic gaming unit comprising:

a display unit;

a time generator configured to generate a time signal indicative of a time of day;

an input device configured to receive input;

a credit accepting mechanism configured to accept a medium of credit; and a controller operatively coupled to the display unit, the time generator and the input device, the controller comprising a processor and a memory operatively coupled to the processor, the controller being programmed to:

receive a signal from the input device indicating the gambling game to be played from a selection of gambling games available to be played, wherein the signal is generated in response to input, change the selection of gambling games available to be played in response to the time signal, determine, after a sequence of images has been displayed, an outcome of the selected gambling game represented by the sequence of images, and determine a currency payout associated with the outcome of the selected gambling game.

19. The electronic gaming unit of claim 18 wherein the time generator comprises an internal clock configured to generate the time signal.

20. The electronic gaming unit of claim 18 wherein the time generator is configured to receive the time signal from a location external to the gaming unit.

21. The electronic gaming unit of claim 18 additionally comprising an audio speaker and wherein the controller is programmed to change a volume emitted from the speaker in response to the time signal.

22. The electronic gaming unit of claim 18 wherein the controller is programmed to change a payout percentage in response to the time signal.

23. The electronic gaming unit of claim 18 wherein the controller is programmed to change a brightness of the display unit in response to the time signal.

24. The electronic gaming unit of claim 18 wherein the controller is programmed to change a theme of the selected gambling game in response to the time signal.

25. The electronic gaming unit of claim 18 wherein the controller is programmed to replace a first available bonus game for a second available bonus game in response to the time signal.

26. The electronic gaming unit of claim 25 wherein the first available bonus game is associated with a first potential payout and the second available bonus game is associated with a second potential payout.

27. The electronic gaming unit of claim 18, wherein the controller is programmed to change a denomination for the medium of credit required to begin the selected gambling game in response to the time signal.

28. The electronic gaming unit of claim 18, wherein the controller is programmed to change a maintenance schedule of the gaming unit in response to the time signal.

* * * * *